US006027867A

United States Patent [19]

Ishige et al.

[11] Patent Number: 6,027,867

[45] Date of Patent: Feb. 22, 2000

[54] SILVER HALIDE COLOR PHOTOGRAPHIC LIGHT SENSITIVE MATERIAL

[75] Inventors: Osamu Ishige; Masakazu Tonishi; Masato Nishizeki; Naoki Sato, all of Hino, Japan

[73] Assignee: Konica Corporation, Japan

[21] Appl. No.: 09/100,722

[22] Filed: Jun. 19, 1998

[30] Foreign Application Priority Data

Jun. 25, 1997 [JP] Japan ..... 8-168844

[51] Int. Cl.[7] ..... G03C 1/08; G03C 7/26; G03C 7/32

[52] U.S. Cl. ..... 430/544; 430/557; 430/957

[58] Field of Search ..... 430/557, 544, 430/505, 957

[56] References Cited

U.S. PATENT DOCUMENTS

| | | | |
|---|---|---|---|
| 4,246,333 | 1/1981 | Fuseya et al. | 430/544 |
| 4,359,521 | 11/1982 | Fryberg et al. | 430/557 |
| 4,579,816 | 4/1986 | Ohlschlager et al. | 430/544 |
| 5,021,331 | 6/1991 | Vetter et al. | 430/544 |
| 5,709,987 | 1/1998 | Begley et al. | 430/557 |
| 5,736,307 | 4/1998 | Bertoldi et al. | 430/557 |

*Primary Examiner*—Geraldine Letscher
*Attorney, Agent, or Firm*—Jordan B. Bierman; Bierman, Muserlian and Lucas

[57] ABSTRACT

A silver halide light sensitive color photographic material comprising a support having thereon hydrophilic colloid layers including a silver halide emulsion layer, at least one of the hydrophilic colloid layers containing a DIR coupler represented by the following formulas:

wherein Y represents a yellow coupler moiety, and the residual atomic group represents a development inhibitor residue capable of being released from Y upon coupling reaction with an oxidation product of a color developing agent.

4 Claims, No Drawings

SILVER HALIDE COLOR PHOTOGRAPHIC LIGHT SENSITIVE MATERIAL

FIELD OF THE INVENTION

The present invention is related to a silver halide light sensitive photographic material, and in particular, to a silver halide light sensitive color photographic material improved in photographic characteristics and storage stability.

BACKGROUND OF THE INVENTION

Currently, there is a strong desire for development of a silver halide light sensitive color photographic material superior in sensitivity, sharpness and color reproduction.

There is known, as a means for improving sharpness, a DIR compound capable of releasing a development inhibitor upon reaction with an oxidation product of a developing agent. As is known, incorporation of the DIR compound into a silver halide emulsion leads to improved color reproduction due to an edge effect. When using the DIR compound, however, the development inhibitor released upon color development is leached out from the photographic material and accumulates in the processing solution, leading to defects such that the processing solution adversely retards development.

There have been proposed couplers to overcome such problems, as disclosed in JP-A 57-151944, 58-205150, 60-218644 and 60-221750 and 61-11743 (herein, the term "JP-A" means unexamined and published Japanese Patent Application) and U.S. Pat. No. 4,782,012. These couplers contains a releasable group having properties such that when released from the coupling position of the coupler, the group exhibits developing inhibition and after leached out into the processing solution, it is decomposed to a compound inactive to photographic characteristics. In fact, in the use of these couplers, lowering of sensitivity and staining of a developing solution were reduced, even when large amounts of photographic materials were processed. However, photographic materials containing the coupler described above, exhibited variation in photographic characteristics and deterioration in sharpness and color reproduction during storage, and the photographic performance of the coupler itself was proved to be insufficient in terms of the edge effect and the interlayer effect.

SUMMARY OF THE INVENTION

It is an object of the present invention to provide a silver halide color photographic material superior in sharpness, exhibiting an marked interlayer effect and improved in storage stability.

The above object of the present invention can be accomplished by the following constitution:

(1) a silver halide light sensitive color photographic material containing a compound represented by the following formula (101):

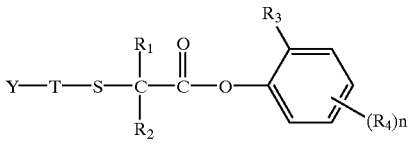

wherein Y represents a yellow coupler moiety capable of coupling reaction with an oxidation product of a color developing agent; T represents a 1,2,4-triazole skeleton or 1.2,3-triazole skeleton, provided that T is linked to a coupling position of Y through a nitrogen atom contained in T and may be substituted; S represents a sulfur atom which is linked to a carbon atom contained in T; $R_1$ represents a hydrogen atom, an alkyl group or an aryl group, each of which may be substituted; $R_2$ represents an alkyl group or an aryl group, each of which may be substituted; $R_3$ represents an alkyl group or an aryl group, each of which may be substituted; $R_4$ represents a substituent capable of being substituted on a benzene ring; and n is an integer of 0, 1, 2, 3 or 4, provided that when n is 2 or more, $R_4$s may be the same or different;

(2) a silver halide light sensitive color photographic material containing a compound represented by the following formula (201):

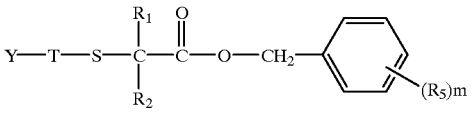

wherein Y represents a yellow coupler moiety capable of coupling reaction with an oxidation product of a color developing agent; T represents a 1,2,4-triazole skeleton or 1.2,3-triazole skeleton, provided that T is linked to a coupling position of Y through a nitrogen atom contained in T and may be substituted; S represents a sulfur atom which is linked to a carbon atom contained in T; $R_1$ represents a hydrogen atom, an alkyl group or an aryl group, each of which may be substituted; $R_2$ represents an alkyl group or an aryl group, each of which may be substituted; $R_5$ represents a substituent capable of being substituted on a benzene ring; and m is an integer of 0, 1, 2, 3, 4 or 5, provided that when m is 2 or more, $R_4$s may be the same or different;

(3) a silver halide light sensitive color photographic material containing a compound represented by the following formula (301):

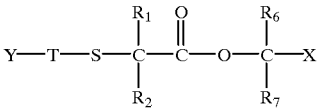

wherein Y represents a yellow coupler moiety capable of coupling reaction with an oxidation product of a color developing agent; T represents a 1,2,4-triazole skeleton or 1.2,3-triazole skeleton, provided that T is linked to a coupling position of Y through a nitrogen atom contained in T and may be substituted; S represents a sulfur atom which is linked to a carbon atom contained in T; $R_1$ represents a hydrogen atom, an alkyl group or an aryl group, each of which may be substituted; $R_2$ represented an alkyl group or an aryl group, each of which may be substituted; $R_6$ represents a hydrogen atom, an alkyl group or an aryl group, each of which may be substituted; $R_7$ represents an alkyl group or an aryl group, each of which may be substituted; and X represents oxycarbonyl, carbamoyl or carbonyl group;

(4) a silver halide light sensitive color photographic material containing a compound represented by the following formula (401):

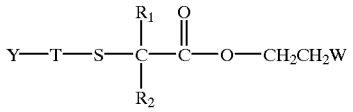

wherein Y represents a yellow coupler moiety capable of coupling reaction with an oxidation product of a color developing agent; T represents a 1,2,4-triazole skeleton or 1.2,3-triazole skeleton, provided that T is linked to a coupling position of Y through a nitrogen atom contained in T and may be substituted; S represents a sulfur atom which is linked to a carbon atom contained in T; $R_1$ represents a hydrogen atom, an alkyl group or an aryl group, each of which may be substituted; $R_2$ represented an alkyl group or an aryl group, each of which may be substituted; W represents aryloxy, arylthio or sulfonyl group, each of which may be substituted.

DETAILED DESCRIPTION OF THE INVENTION

In formula (101), examples of the yellow coupler moiety represented by Y include a malonic diamide type, malonic eater monoamide type, malonic diester type, benzoyl acetoanilide type, cycloalkanoyl acetoamide type, pivaloyl acetoanilide type, dibenzoyl methane type, benzothiazolyl acetoamide type, benzooxazolyl acetoamide type and benzoimidazolyl acetoamide type. Exemplary examples thereof are described in U.S. Pat. Nos. 2,298,443, 2,407,210, 2,875,057, 3,048,194, 3,265,506 and 3,447,928. In addition to the above are also included coupler moieties described in U.S. Pat. Nos. 5,021,332 and 5,021,330, and European patent 421,221A.

Preferred yellow coupler moieties represented by Y in formula (101) are those having the following structure, in which the symbol "*" indicates the position linking with T.

Y-1

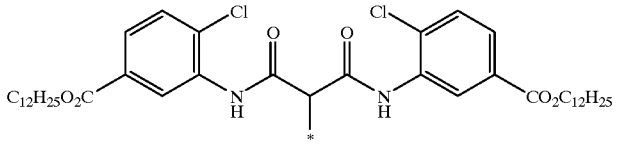

Y-2

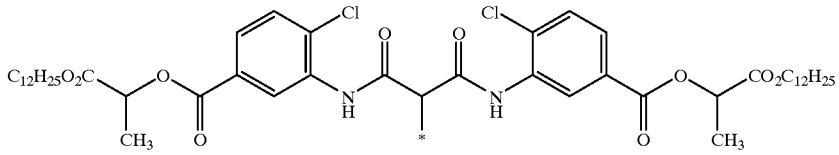

Y-3

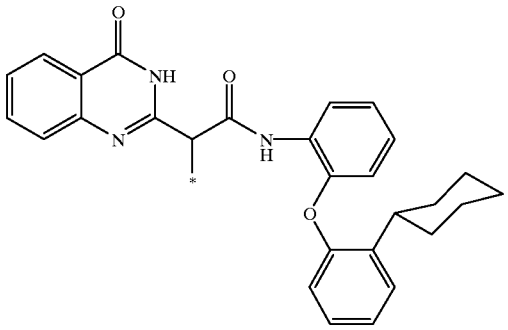

Y-4

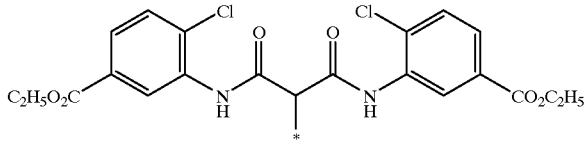

Y-5

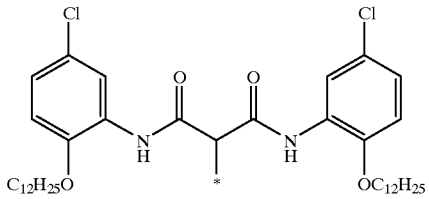

-continued

Y-6

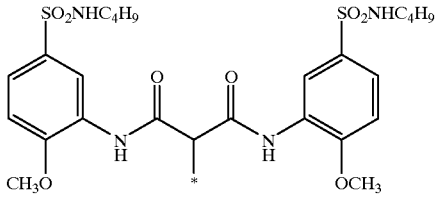

Y-7

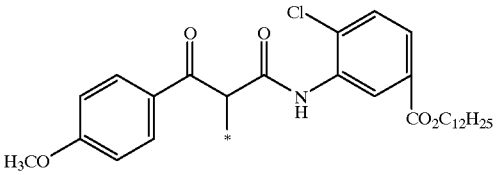

Y-8

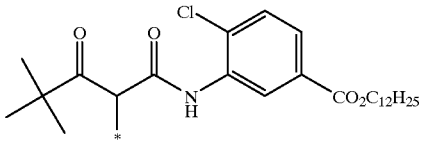

Y-9

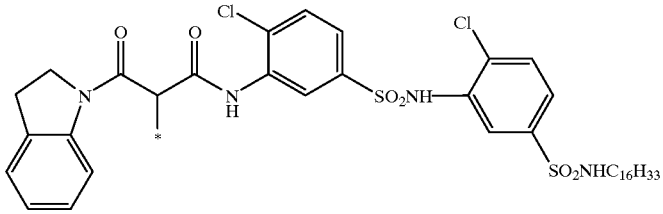

Y-10

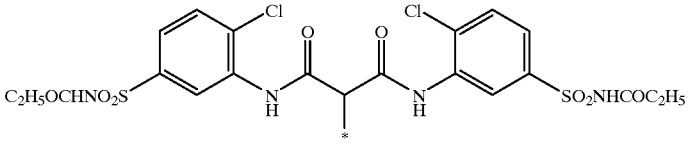

Examples of the group represented by T in formula (101) include ones represented by the following formulas (102), (103), (104), (105), (106) and (107):

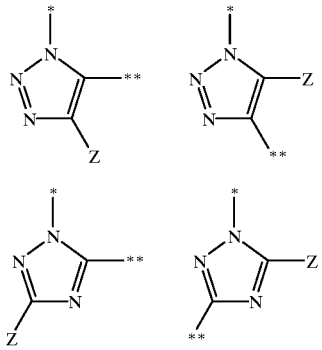

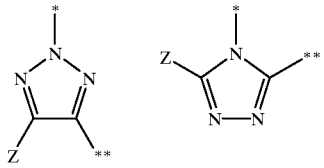

In formulas (102) through (107), the symbol "*" represents the position linking with the yellow coupler moiety, Y and the symbol "**" represents the position linking with the S atom in formula (101). In formulas (102) to (105), Z represents a hydrogen atom or substituent. Preferred examples of the substituent represented by Z include an alkyl group (e.g., methyl, isopropyl, cyclopropyl, etc.), an aryl group (e.g., phenyl tolyl), a heterocyclic group (e.g., furyl, thienyl, pyridyl), an alkylthio group (e.g., methylthio, t-octylthio, etc.), an arylthio group (e.g., phenylthio), and an oxycarbonyl group (e.g., alkoxycarbonyl such as methoxycarbonyl or cyclohexyloxycarbonyl, aryloxycarbonyl such as phenoxycarbonyl, heterocyclooxycarbonyl, etc.).

In formula (101), $R_1$ represents a hydrogen atom, an alkyl group, which may be substituted (e.g., methyl, isopropyl, cyclopropyl, 2-chloroethyl, etc.) or an aryl group, which may be substituted (e.g., phenyl, tolyl, p-methoxyphenyl, etc.). $R_1$ is preferably a hydrogen atom.

In formula (101), $R_2$ represents an alkyl group, which may be substituted (e.g., methyl, isopropyl, cyclopropyl, t-butyl, 2-chloroethyl, etc.) or an aryl group (e.g., phenyl, tolyl, p-methoxyphenyl, etc.). $R_2$ is preferably an alkyl group and more preferably an alkyl group having carbon atoms of 4 or less.

In formula (101), $R_3$ represents an alkyl group, which may be substituted (e.g., methyl, isopropyl, cyclopropyl, t-butyl, 2-chloroethyl, etc.) or an aryl group (e.g., phenyl, tolyl, p-methoxyphenyl, etc.). $R_3$ is preferably an alkyl group having 8 or less carbon atoms and more preferably an alkyl group having 4 or less carbon atoms.

In formula (101), $R_4$ represents a substituent capable of being substituted on a benzene ring. Examples of the substituent include an aryl group and aryl group, which are the same as defined in $R_1$, $R_2$ and $R_3$; a heterocyclic group (e.g., 2-tetrahydrofuryl, 4-imidazolyl, indoline-1-yl, 2-pyridyl, etc.), a carbonyl group (e.g., alkyl carbonyl such as acetyl and trifluoroacetylpivaloyl, arylcarbonyl such as benzoyl, pentafluorobenzoyl, 3,5-di-t-butyl-4-hydroxybenzoyl), an oxycarbonyl group (e.g., alkoxycarbonyl such as methoxycarbonyl, cyclohexyloxycarbonyl or n-dodecyloxycarbonyl; aryloxycarbonyl such as phenoxycarbonyl, 2,4-di-t-amylphenoxycarbonyl or 1-naphthyloxycarbonyl; or heterocyclooxycarbonyl such as 2-pyridyloxycarbonyl or 1-phenylpyrazolyl-5-oxycarbonyl), a carbamoyl group [e.g., alkylcarbamoyl such as 4-(2,4-di-t-amylphenoxy)butylaminocarbonyl, arylcarbamoyl such as phenylcarbamoyl or 1-naphthylcarbamoyl, etc.], a sulfonyl group (e.g., alkylsulfonyl such as methanesulfonyl or trifluoromethanesulfonyl; arylsulfonyl such as p-toluenesulfonyl), a sulfamoyl group [e.g., alkylsulfamoyl such as dimethylsulfamoyl or 4-(2,4-di-t-amylphenoxy) butylaminosulfonyl; arylsulfamoyl such as phenylsulfamoyl], a halogen atom (e.g., chlorine atom, bromine atom, etc.), cyano, nitro, an alkenyl group (e.g., 2-propylene, oleyl, etc.), hydroxy, an alkoxy group (e.g., methoxy, 2-ethoxyethoxy, etc.), an aryloxy group [e.g., phenoxy, 2,4-di-t-amylphenoxy, 4-(4-hydroxyphenylsulfonyl)phenoxy], a heterocyclooxy group (e.g., 4-pyridyloxy, 2-hexahydropiranyloxy, etc.), a carbonyloxy group (e.g., alkylcarbonyloxy such as acetyloxy, trifluoroacetyloxy or pivaloyloxy; arylcarbonyloxy such as benzoyloxy, pentafluorobenzoyloxy, etc.), a urethane group [e.g., alkylurethane such as N,N-dimethylurethane; arylurethane such as N-phenylurethane or N-(p-cyanophenyl) urethane], a sulfonyloxy group (e.g., alkylsulfonyloxy such as methanesulfonyloxy, trifluoromethanesulfonyloxy or n-dodecanesulfonyloxy; arylsulfonyloxy such as benzenesulfonyloxy or p-toluenesulfonyloxy), an amino group (e.g., alkylamino such as dimethylamino, cyclohexylamino or n-dodecylamino, arylamino such as anilino or p-t-octylanilino), a sulfonylamino group (e.g., alkylsulfonylamino such as methanesulfonylamino, heptafluoropropanesulfonylamino or n-hexadecylsulfonylamino; arylsulfonylamino such as p-toluenesulfonylamino or pentafluorobenzenesulfonylamino), a sulfamoylamino group (e.g., alkylsulfamoylamino such as N,N-dimethylsulfamoylamino; arylsulfamoylamino such as N-phenylsulfamoylamino), an acylamino group (e.g., alkylcarbonylamino such as acetylamino or myristoylamino; arylcarbonylamino such as benzoylamino), a ureido group [e.g., alkylureido such as N,N-dimethylureido, arylureido such as N-phenylureido or N-(p-cyanophenyl)ureido], an alkylthio group (e.g., methylthio, t-octylthio, etc.) and an arylthio group (e.g., phenylthio).

$R_4$ is preferably an alkyl group, an aryl group, a heterocyclic group, an alkoxy group, an aryloxy group or an acylamino group; and more preferably, an alkyl group having 8 or less (still more preferably, 4 or less) carbon atoms. The substituting position of $R_4$ is preferably 6-position (o-position).

In formula (101), an atomic group including T, except for Y, represents a development inhibitor residue, which is released from Y upon coupling reaction with an oxidation product of a color developing agent. Specifically are preferred development inhibitors having the following structure, which is represented by the form, in which a hydrogen atom is attached to a development inhibitor represented by a structural formula of an atomic group including T, except for Y.

INH-109

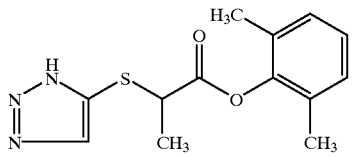

INH-102

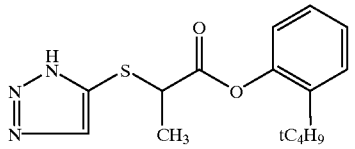

INH-103

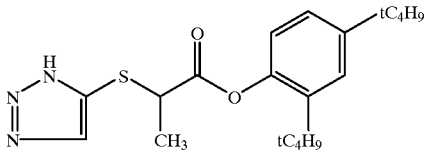

INH-104

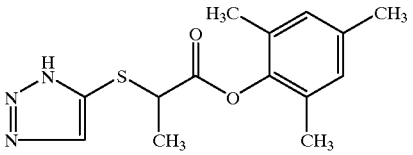

INH-105

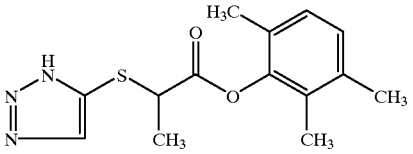

INH-106

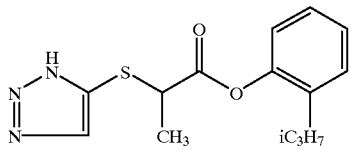

-continued

INH-107

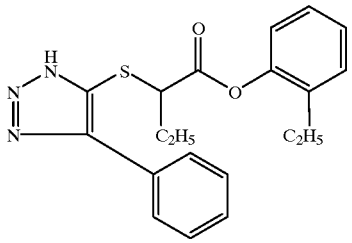

INH-108

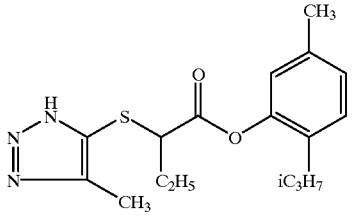

INH-109

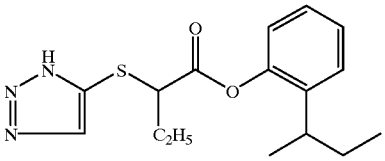

INH-110

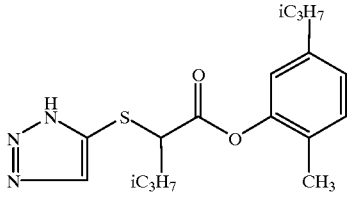

INH-111

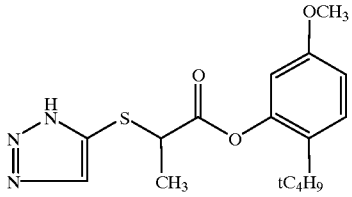

INH-112

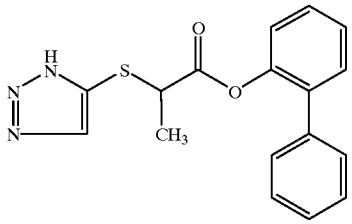

INH-113

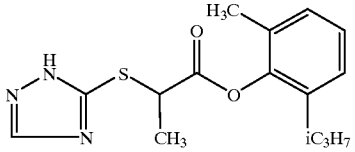

-continued

INH-114

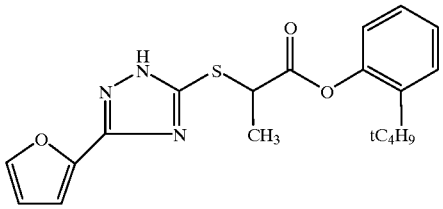

In formula (201), Y, T, $R_1$ and $R_2$ are respectively the same as defined in Y, T, $R_1$ and $R_2$ of formula (101). $R_5$ represents a substituent capable of being substituted on a benzene ring, including the same one as exemplified in formula (101). Preferred examples of $R_5$ of formula (201) include a halogen atom, a carbonyl group, an oxycarbonyl group, a carbamoyl group, a sulfonyl group, a sulfamoyl group, a cyano group, and a nitro group. Of these are preferred a halogen atom or an alkoxycarbonyl group. Still more preferred $R_5$ is an alkoxycarbonyl group having 6 or less carbon atoms.

In formula (201), an atomic group including T, except for Y, represents a development inhibitor residue, which is released from Y upon coupling reaction with an oxidation product of a color developing agent. Specifically are preferred development inhibitors having the following structure, which is represented by the form, in which a hydrogen atom is attached to a development inhibitor represented by a structural formula of an atomic group including T, except for Y.

INH-201

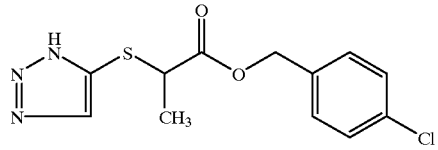

INH-202

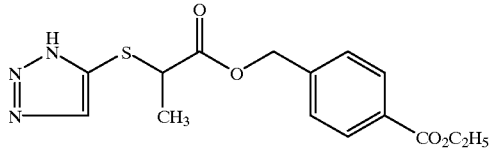

INH-203

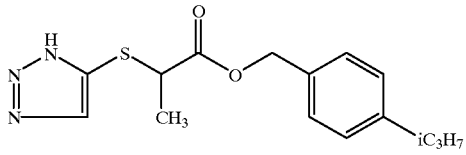

INH-204

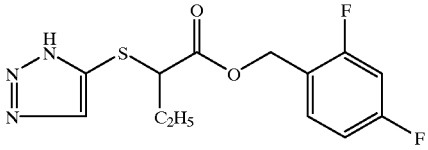

-continued

INH-205

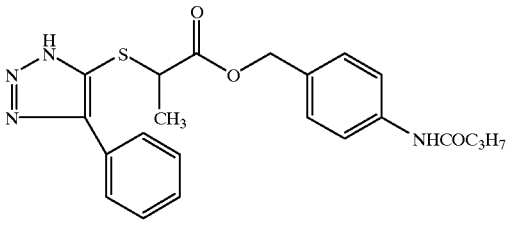

INH-206

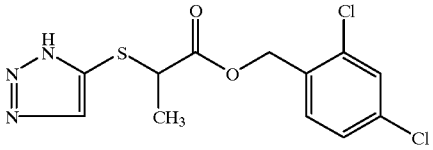

INH-207

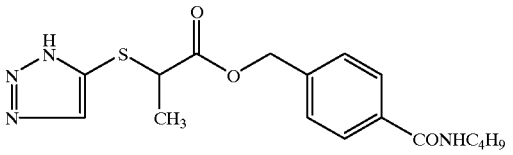

INH-208

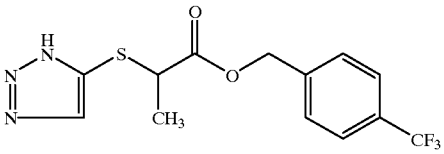

INH-209

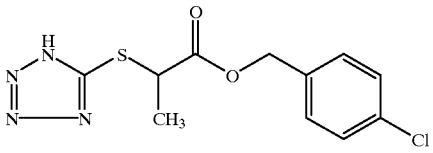

INH-210

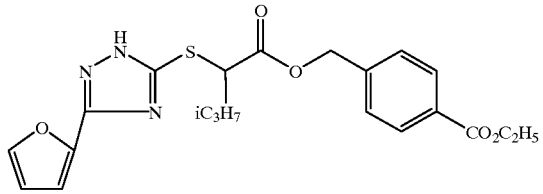

INH-211

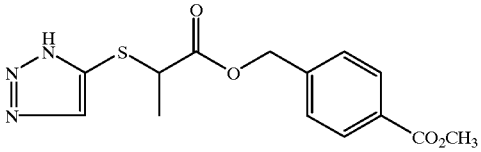

In formula (301), Y, T, $R_1$ and $R_2$ are respectively the same as defined in Y, T, $R_1$ and $R_2$ of formula (101); $R_6$ represents a hydrogen atom, an alkyl group, which may be substituted (e.g., methyl, isopropyl, cyclopropyl, 2-chloroethyl, etc.) or an aryl group (e.g., phenyl, tolyl, p-methoxyphenyl, etc.). of these is preferred a hydrogen atom. $R_7$ represents a hydrogen atom, an alkyl group, which may be substituted (e.g., methyl, isopropyl, cyclopropyl, t-butyl, 2-chloroethyl, etc.) or an aryl group (e.g., phenyl, tolyl, p-methoxyphenyl, etc.). Of these is preferred an alkyl group (more preferably, having 4 or less carbon atoms). X represents an oxycarbonyl group (e.g., alkoxycarbonyl such as methoxycarbonyl, cyclohexyloxycarbonyl or n-dodecyloxycarbonyl; aryloxycarbonyl such as phenoxycarbonyl, 2,4-di-t-amylphenoxycarbonyl or 1-naphthyloxycarbonyl; or heterocyclooxycarbonyl such as 2-pyridyloxycarbonyl or 1-phenylpirazolyl-5-oxycarbonyl), a carbamoyl group [e.g., alkylcarbamoyl such as dimethylcarbamoyl, 4-(2,4-di-t-amylphenoxy) butylaminocarbonyl; arylcarbamoyl such as phenylcarbamoyl or 1-naphthylcarbamoyl], or a carbonyl group (e.g., alkylcarbonyl such as acetyl or trifluoroacetylpivaloyl; arylcarbonyl such as benzoyl, pentafluorobenzoyl or 3,5-di-t-butyl-4-hydroxybenzoyl). Of these, X is preferably an oxycarbonyl group, and more preferably, an alkoxycarbonyl group having 7 or less carbon atoms. In formula (301), an atomic group including T, except for Y, represents a development inhibitor residue, which is released from Y upon coupling reaction with an oxidation product of a color developing agent. Specifically are preferred development inhibitors having the following structure (which is represented by the form, in which a hydrogen atom is attached to a development inhibitor represented by a structural formula of an atomic group including T, except for Y).

INH-301

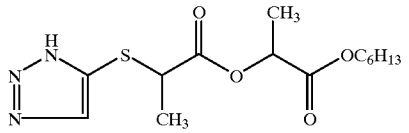

INH-302

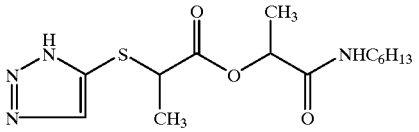

INH-303

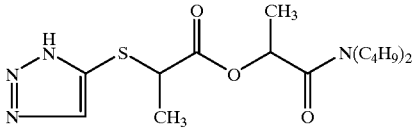

INH-304

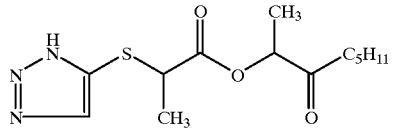

INH-305

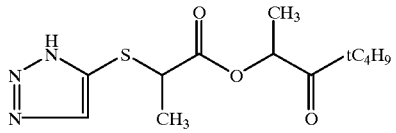

INH-306

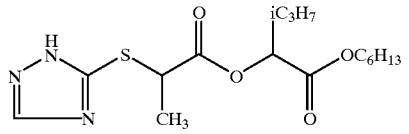

In formula (401), Y, T, $R_1$ and $R_2$ are respectively the same as defined in Y, T, $R_1$ and $R_2$ of formula (101); W represents an aryloxy group [e.g., phenoxy, p-ethoxycarbonylphenoxy, 2,4-di-t-amylphenoxy, 4-(4-hydroxyphenylsulfonyl)phenoxy, etc.], or an arylthio group (e.g., phenylthio, p-ethoxycarbonylphenylthio, etc.)a sulfonyl group (e.g., alkylsulfonyl such as methanesulfonyl or trifluoromethanesulfonyl; arylsulfonyl such as p-toluenesulfonyl). Of these, W is preferably an aryloxy group and more preferably a substituted phenoxy group. In formula (401), an atomic group including T, except for Y, represents a development inhibitor residue, which is released from Y upon coupling reaction with an oxidation product of a color developing agent. Specifically are preferred development inhibitors having the following structure (which is represented by the form, in which a hydrogen atom is attached to a development inhibitor represented by a structural formula of an atomic group including T, except for Y).

INH-401

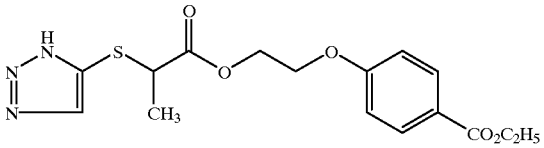

INH-402

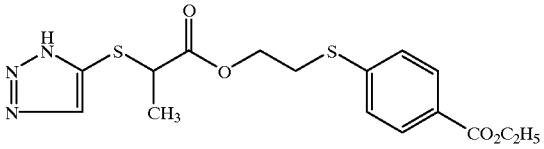

INH-403

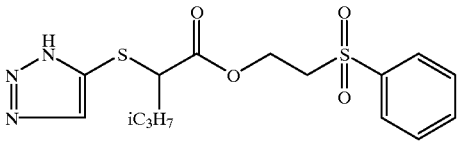

INH-404

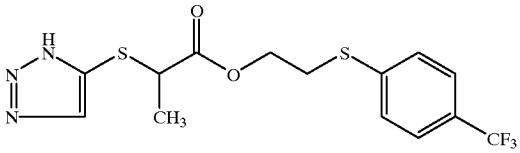

INH-405

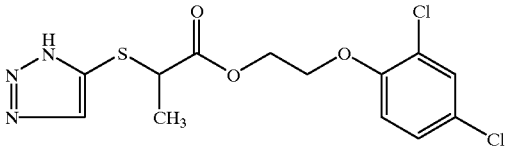

INH-406

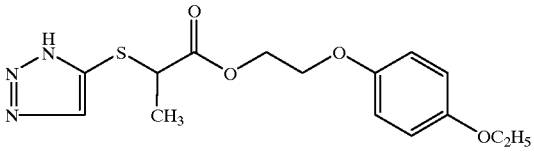

INH-407

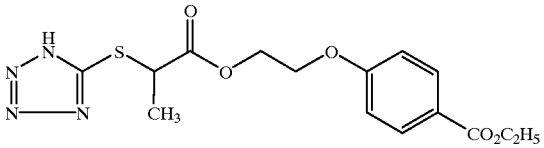

Exemplary examples of the compound represented by formula (101) are shown below, but the present invention is by no means limited to these.

TABLE 1

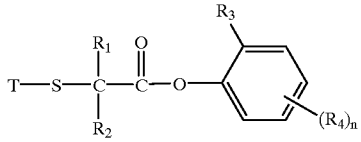

| No. | Y— | |
|---|---|---|
| 101 | Y-1 | INH-101 |
| 102 | Y-1 | INH-102 |
| 103 | Y-1 | INH-104 |
| 104 | Y-1 | INH-113 |
| 105 | Y-2 | INH-101 |
| 106 | Y-3 | INH-101 |
| 107 | Y-3 | INH-102 |
| 108 | Y-4 | INH-103 |
| 109 | Y-5 | INH-109 |
| 110 | Y-6 | INH-113 |
| 111 | Y-7 | INH-114 |
| 112 | Y-8 | INH-112 |
| 113 | Y-9 | INH-101 |
| 114 | Y-10 | INH-106 |

Further, exemplary examples of the compounds represented by formula (201), (301) and (401) are shown in Tables 2, 3 and 4, but the present invention is by no means limited to these.

TABLE 2

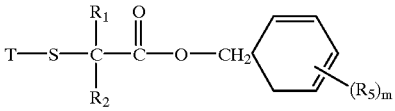

| No. | Y— | |
|---|---|---|
| 201 | Y-1 | INH-201 |
| 202 | Y-1 | INH-202 |
| 203 | Y-1 | INH-204 |
| 204 | Y-1 | INH-206 |
| 205 | Y-2 | INH-202 |
| 206 | Y-3 | INH-201 |
| 207 | Y-3 | INH-202 |
| 208 | Y-4 | INH-203 |
| 209 | Y-5 | INH-211 |
| 210 | Y-6 | INH-203 |
| 211 | Y-7 | INH-210 |
| 212 | Y-8 | INH-212 |
| 213 | Y-1 | INH-211 |

TABLE 3

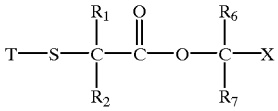

| No. | Y— | |
|---|---|---|
| 301 | Y-1 | INH-301 |
| 302 | Y-1 | INH-304 |
| 303 | Y-1 | INH-306 |
| 304 | Y-2 | INH-301 |
| 305 | Y-3 | INH-301 |
| 306 | Y-8 | INH-305 |
| 307 | Y-9 | INH-302 |

TABLE 4

| No. | Y— | $T-S-C(R_1)(R_2)-C(=O)-O-CH_2CH_2W$ |
|---|---|---|
| 401 | Y-1 | INH-401 |
| 402 | Y-1 | INH-402 |
| 403 | Y-1 | INH-407 |
| 404 | Y-2 | INH-401 |
| 405 | Y-3 | INH-401 |
| 406 | Y-3 | INH-407 |
| 407 | Y-9 | INH-403 |

Representative examples of synthesis of the compound according to the invention are shown below.

SYNTHESIS EXAMPLE 1

Synthesis of exemplified Compound 101

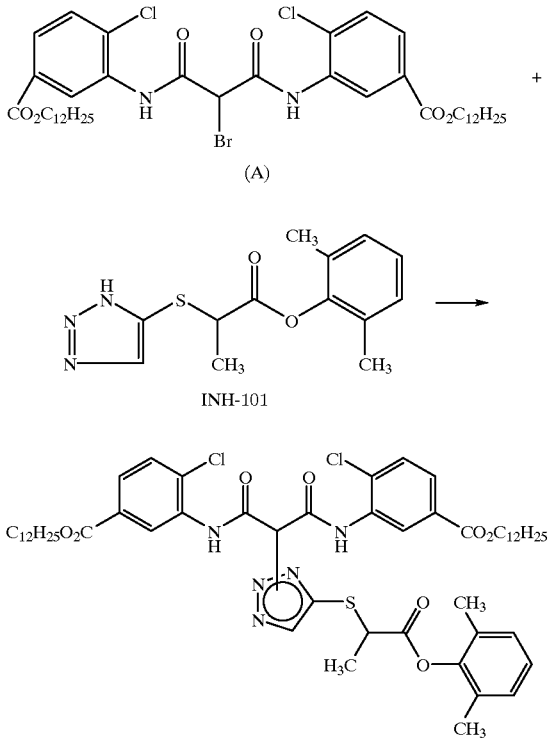

To 50 ml of chloroform was added 5.55 g of INH-101 and 2.02 g of triethylamine was further added thereto at room temperature. Subsequently, 8.27 g of Compound (A) which was dissolved in 100 ml of chloroform was dropwise added. After completing addition, the reaction mixture was continuously stirred at room temperature over a period of 5 hr. After completing reaction, the mixture was washed successively with an aqueous saturated sodium chloride solution, diluted hydrochloric acid and water. After drying with magnesium sulfate, chloroform was distilled away under reduced pressure. The resulting concentrated residue in the form of syrup was refined through silica gel column chromatography using, as a developing solution, a ethyl acetate/hexane mixed solvent to obtain 4.50 g of exemplified Compound 101. The compound was identified through NMR spectrum and MS spectrum.

SYNTHESIS EXAMPLE 2

Synthesis of exemplified Compound 207

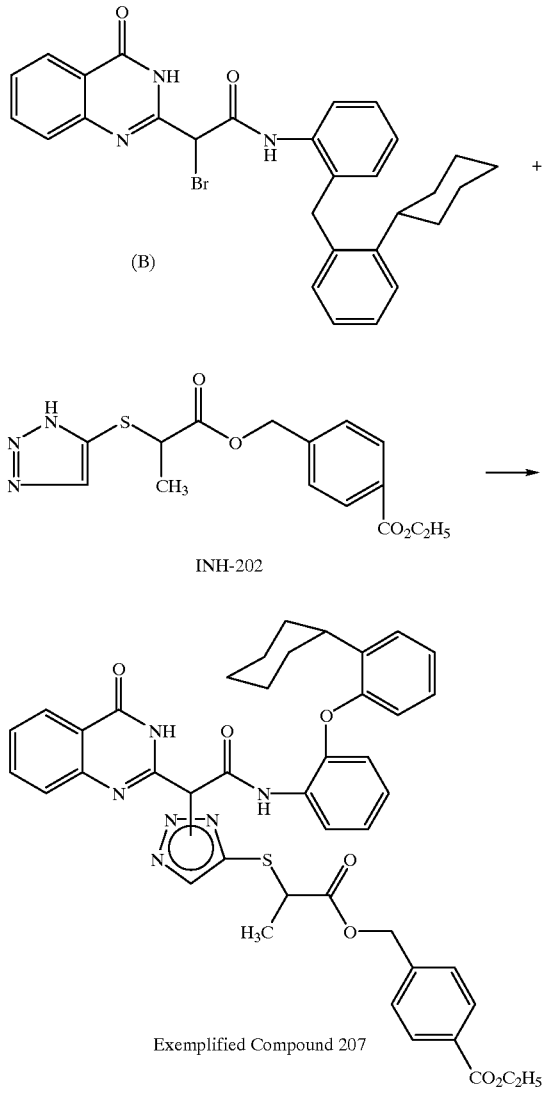

To 100 ml of DMF were added 5.32 g of Compound (B) and 6.17 g of INH-202 and then 2.30 g of tetramethylguanidine was added. Subsequently, the mixture was continuously stirred at room temperature over a period of 5 hr. After completing reaction, the reaction mixture was poured into 500 ml of water and extracted with ethyl acetate and the mixture was further washed successively with an aqueous saturated sodium chloride solution, diluted hydrochloric acid and water. After drying with magnesium sulfate, ethyl acetate was distilled away under reduced pressure. The resulting concentrated residue in the form of syrup was refined through silica gel column chromatography using, as a developing solution, a ethyl acetate/hexane mixed solvent to obtain 4.50 g of exemplified Compound 207. The compound was identified through NMR spectrum and MS spectrum.

SYNTHESIS EXAMPLE 3

Synthesis of exemplified Compound 301

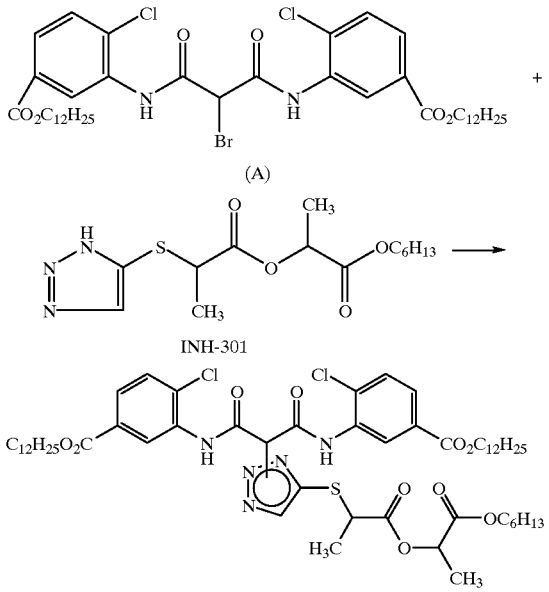

Exemplified Compound 301

To 50 ml of chloroform was added 6.59 g of INH-101 and 2.02 g of triethylamine was further added thereto at room temperature. Subsequently, 8.27 g of Compound (A) which was dissolved in 100 ml of chloroform was dropwise added. After completing addition, the reaction mixture was continuously stirred at room temperature over a period of 5 hr. After completing reaction, the mixture was washed successively with an aqueous saturated sodium chloride solution, diluted hydrochloric acid and water. After drying with magnesium sulfate, chloroform was distilled away under reduced pressure. The resulting concentrated residue in the form of syrup was refined through silica gel column chromatography using, as a developing solution, a ethyl acetate/hexane mixed solvent to obtain 4.52 g of exemplified Compound 301. The compound was identified through NMR spectrum and MS spectrum.

SYNTHESIS EXAMPLE 4

Synthesis of exemplified Compound 401

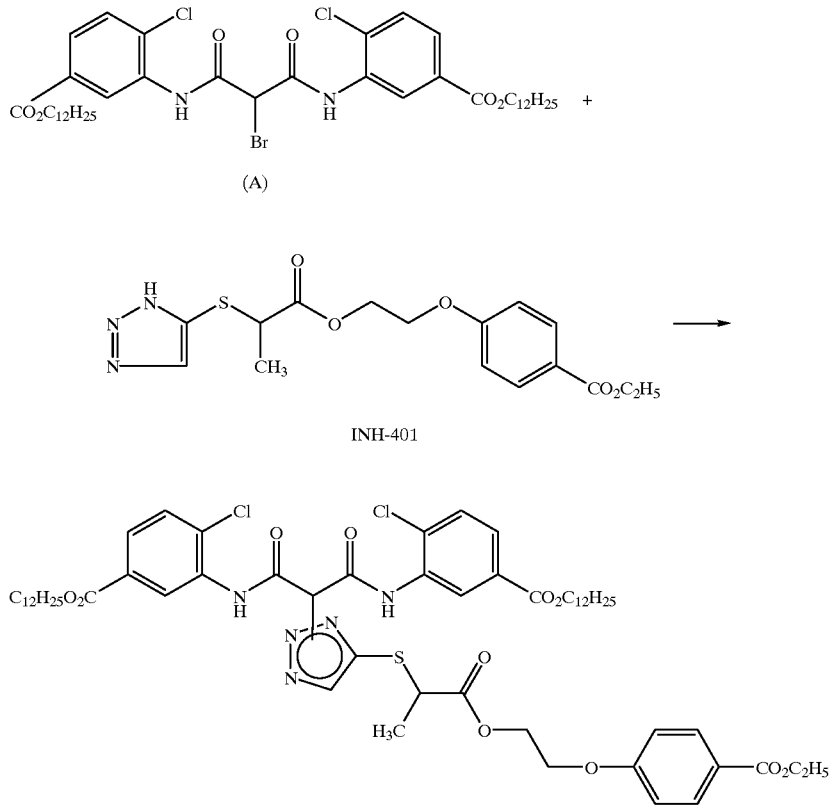

To 50 ml of chloroform was added 7.31 g of INH-101 and 2.02 g of triethylamine was further added thereto at room temperature. Subsequently, 8.27 g of Compound (A) which was dissolved in 100 ml of chloroform was dropwise added. After completing addition, the reaction mixture was continuously stirred at room temperature over a period of 5 hr. After completing reaction, the mixture was washed successively with an aqueous saturated sodium chloride solution, diluted hydrochloric acid and water. After drying with magnesium sulfate, chloroform was distilled away under reduced pressure. The resulting concentrated residue in the form of syrup was refined through silica gel column chromatography using, as a developing solution, a ethyl acetate/hexane mixed solvent to obtain 4.88 g of exemplified Compound 401. The compound was identified through NMR spectrum and MS spectrum.

The compound represented by formula (101), (201), (301) or (401) according to the invention (hereinafter, referred to as DIR coupler relating to the invention) may be incorporated into any layer of a silver halide photographic material, such as a silver halide emulsion layer and/or light-insensitive hydrophilic colloidal layer and preferably into a silver halide emulsion layer. More preferably, the compound is incorporated into a blue-sensitive silver halide emulsion layer and/or green-sensitive silver halide emulsion layer.

To allow the DIR coupler relating to the invention to be incorporated into a hydrophilic colloidal layer of a color photographic material, the DIR coupler, alone of in combination, is dissolved in a high boiling solvent such as dibutyl phthalate, tricresyl phthalate or dinonyl phenol or its mixture with a low boiling solvent such as ethyl acetate or ethyl propionate, mixed with an aqueous solution containing a surfactant, emulsified using a high-speed rotary mixer, colloid mill or ultrasonic homogenizer, and then is incorporated, into an emulsion, directly or in a manner such that the emulsified dispersion described above was set, cut, washed and then added to the emulsion.

The DIR coupler is incorporated preferably in an amount of 0.0005 to 5.0 mol per mol of silver halide, and more preferably 0.002 to 1.0 mol per mol of silver halide. The DIR coupler may be used singly or in combination.

As a silver halide emulsion usable in the photographic material according to the present invention, there may be used any one of conventional silver halide emulsions. The emulsion can be chemically sensitized in a conventional manner and spectrally sensitized to desired wavelength region using a sensitizing dye.

To a silver halide emulsion layer, an antifoggant or stabilizer may be added. Gelatin is advantageously employed as binder for the emulsion. The emulsion layer and other hydrophilic colloidal layer may be hardened. There may be incorporated a plasticizer or a dispersion of water-insoluble or scarcely water-soluble polymer (latex).

Couplers are incorporated into emulsion layer(s) of a silver halide color photographic material according to the invention. In addition, there may be incorporated a colored coupler having effects of color correction, a competing coupler or a compound capable of releasing, upon coupling reaction with an oxidation product of a color developing agent, a photographically useful fragment, such as development accelerator, bleach accelerator, developer, silver halide solvent, toning agent, antifoggant, chemical sensitizer, spectral sensitizer or desensitizer.

There may be provided a auxiliary layer filter layer, antihalation layer or antiirradiation layer in the photographic material. In any one of these layers and/or an emulsion layer may be incorporated a dye capable of being leached out of the photographic material or being bleached during processing.

There may be further incorporated, into the photographic material, a matting agent, lubricant, image stabilizer, surfactant, anti-color-staining agent, development accelerator, development retarder or bleach accelerator.

There may be used a support, such as polyethylene-laminated paper, polyethylene terephthalate film, baryta paper, triacetyl cellulose.

To obtain color images, the silver halide color photographic material according to the invention is processed using a p-phenylenediamine color developing agent, as described in T. H. James, The Theory of The Photographic Process, fourth edition pages 291–334 and Journal of the American Chemical Society, Vol. 73, page 3,100 (1951), in a conventional manner as described in Research Disclosure (RD) 17643 page 28–29; RD 18716 page 615; and RD 308119 XIX.

EXAMPLES

Embodiments of the present invention will be explained based on examples, but are not to be construed as limiting to these examples.

Example 1

On a subbed triacetyl cellulose film support were coated layers having compositions as shown below, successively in this order from the support to prepare a silver halide color photographic material sample 1. The addition amount was represented as g per $m^2$, silver halide and colloidal silver were each represented by equivalent converted to silver, and a sensitizing dye is represented by mol per mol of silver.

| | |
|---|---|
| 1st Layer (Antihalation layer) | |
| Black colloidal silver | 0.16 |
| UV-1 | 0.3 |
| CM-1 | 0.044 |
| OIL-1 | 0.044 |
| gelatin | 1.33 |
| 2nd layer (Interlayer) | |
| AS-1 | 0.160 |
| OIL-1 | 0.20 |
| Gelatin | 1.40 |
| 3rd layer (Low-speed red-sensitive layer) | |
| Silver iodobromide a | 0.12 |
| Silver iodobromide b | 0.50 |
| SD-1 | $3.0 \times 10^{-5}$ |
| SD-2 | $1.5 \times 10^{-4}$ |
| SD-3 | $3.0 \times 10^{-4}$ |
| SD-4 | $3.0 \times 10^{-6}$ |
| C-1 | 0.51 |
| CC-1 | 0.047 |
| OIL-2 | 0.45 |
| AS-2 | 0.005 |
| Gelatin | 1.40 |
| 4th Layer (Medium-speed red-sensitive layer) | |
| Silver iodobromide c | 0.64 |
| SD-1 | $3.0 \times 10^{-5}$ |
| SD-2 | $1.5 \times 10^{-4}$ |
| SD-3 | $3.0 \times 10^{-4}$ |
| C-2 | 0.22 |
| CC-1 | 0.028 |
| DI-1 | 0.002 |
| OIL-2 | 0.21 |
| AS-3 | 0.006 |
| Gelatin | 0.87 |
| 5th Layer (High-speed red-sensitive layer) | |
| Silver iodobromide c | 0.13 |

-continued

| | |
|---|---|
| Silver iodobromide d | 1.14 |
| SD-1 | $3.0 \times 10^{-5}$ |
| SD-2 | $1.5 \times 10^{-4}$ |
| SD-3 | $3.0 \times 10^{-4}$ |
| C-3 | 0.17 |
| CC-1 | 0.029 |
| DI-1 | 0.027 |
| OIL-2 | 0.23 |
| AS-3 | 0.013 |
| Gelatin | 1.23 |
| 6th Layer (Interlayer) | |
| OIL-1 | 0.29 |
| AS-1 | 0.23 |
| Gelatin | 1.00 |
| 7th Layer (Low-speed green-sensitive layer) | |
| Silver iodobromide a | 0.245 |
| Silver iodobromide b | 0.105 |
| SD-4 | $5.0 \times 10^{-4}$ |
| SD-5 | $5.0 \times 10^{-4}$ |
| M-1 | 0.21 |
| CM-2 | 0.039 |
| OIL-1 | 0.25 |
| AS-2 | 0.003 |
| AS-4 | 0.063 |
| Gelatin | 0.98 |
| 8th Layer (Interlayer) | |
| M-1 | 0.03 |
| CM-2 | 0.005 |
| OIL-1 | 0.16 |
| AS-1 | 0.11 |
| Gelatin | 0.80 |
| 9th Layer (Medium-speed green-sensitive layer) | |
| Silver iodobromide e | 0.87 |
| SD-6 | $3.0 \times 10^{-4}$ |
| SD-7 | $6.0 \times 10^{-5}$ |
| SD-8 | $4.0 \times 10^{-5}$ |
| M-1 | 0.17 |
| CM-2 | 0.048 |
| CM-3 | 0.059 |
| DI-2 | 0.012 |
| OIL-1 | 0.29 |
| AS-4 | 0.05 |
| AS-2 | 0.005 |
| Gelatin | 1.43 |
| 10th layer (High-speed green-sensitive layer) | |
| Silver iodobromide f | 1.19 |
| SD-6 | $4.0 \times 10^{-4}$ |
| SD-7 | $8.0 \times 10^{-5}$ |
| SD-8 | $5.0 \times 10^{-5}$ |
| M-1 | 0.09 |
| CM-3 | 0.020 |
| DI-3 | 0.005 |
| OIL-1 | 0.11 |
| AS-4 | 0.026 |
| AS-5 | 0.014 |
| AS-6 | 0.006 |
| Gelatin | 0.78 |
| 11th Layer (Yellow filter layer) | |
| Yellow colloidal silver | 0.05 |
| OIL-1 | 0.18 |
| AS-7 | 0.16 |
| Gelatin | 1.00 |
| 12th Layer (Low-speed blue-sensitive layer) | |
| Silver iodobromide g | 0.29 |
| Silver iodobromide h | 0.19 |
| SD-9 | $8.0 \times 10^{-4}$ |
| SD-10 | $3.1 \times 10^{-4}$ |
| Ya-1 | 0.91 |
| DI-4 | 0.022 |
| OIL-1 | 0.37 |
| AS-2 | 0.002 |
| Gelatin | 1.29 |

-continued

| | |
|---|---|
| 13th layer (high speed blue-sensitive layer) | |
| Silver iodobromide h | 0.13 |
| Silver iodobromide i | 1.00 |
| SD-9 | $4.4 \times 10^{-4}$ |
| SD-10 | $1.5 \times 10^{-4}$ |
| Ya-1 | 0.48 |
| DI-4 | 0.019 |
| OIL-1 | 0.21 |
| AS-2 | 0.004 |
| Gelatin | 1.55 |
| 14th Layer (First protective layer) | |
| Silver iodobromide j | 0.30 |
| UV-1 | 0.055 |
| UV-2 | 0.110 |
| Oil-2 | 0.63 |
| Gelatin | 1.32 |
| 15th Layer (Second protective layer) | |
| PM-1 | 0.15 |
| PM-2 | 0.04 |
| Wax-1 | 0.02 |
| D-1 | 0.001 |
| Gelatin | 0.55 |

Silver iodobromide emulsions described above are as follows, in which the grain size is an edge length of a cube equivalent to the grain volume)

| Emulsion No. | Av. grain size ($\mu$m) | Av. AgI content (mol %) | Diameter/thickness ratio |
|---|---|---|---|
| a | 0.30 | 2.0 | 1.0 |
| b | 0.40 | 8.0 | 1.4 |
| c | 0.60 | 7.0 | 3.1 |
| d | 0.74 | 7.0 | 5.0 |
| e | 0.60 | 7.0 | 4.1 |
| f | 0.65 | 8.7 | 6.5 |
| g | 0.40 | 2.0 | 4.0 |
| h | 0.65 | 8.0 | 1.4 |
| i | 1.00 | 8.0 | 2.0 |
| j | 0.05 | 2.0 | 1.0 |

In addition to the above composition, there were added coating-aid SU-1, SU-2 and SU-3, dispersing-aid SU-4, viscosity-adjusting agent V-1, stabilizer ST-1 and ST-2, antifoggant AF-1, two kinds of polyvinyl pyrrolidone having weight-averaged molecular weights of 10,000 and 1,100,000 (AF-2), restrainer AF-3, AF-4 and AF-5, hardener H-1 and H-2 and antiseptics Ase-1.

Structure of the compounds described above are shown below.

C-1
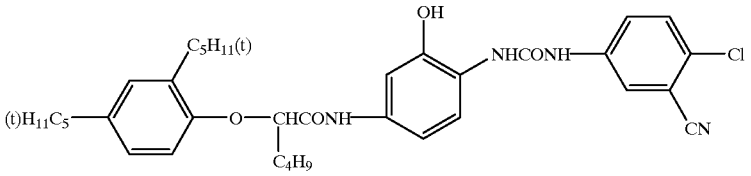
C-2
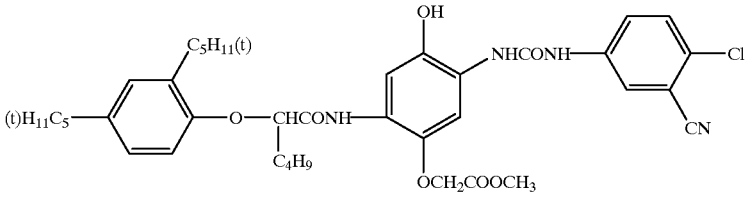
C-3
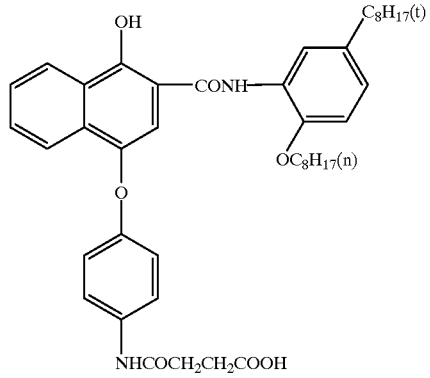
M-1
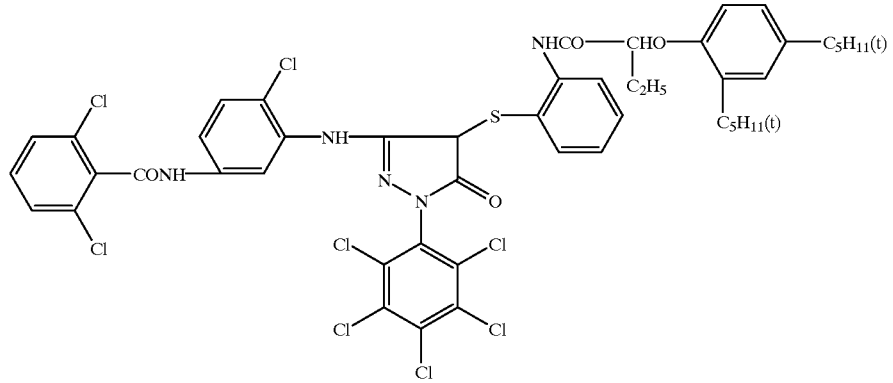
Ya-1
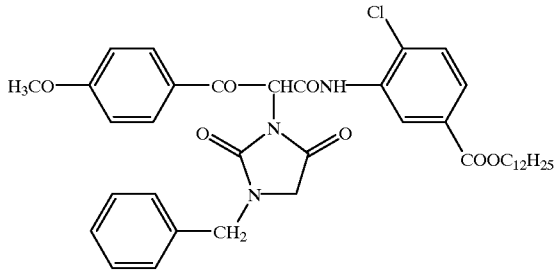

-continued
CC-1
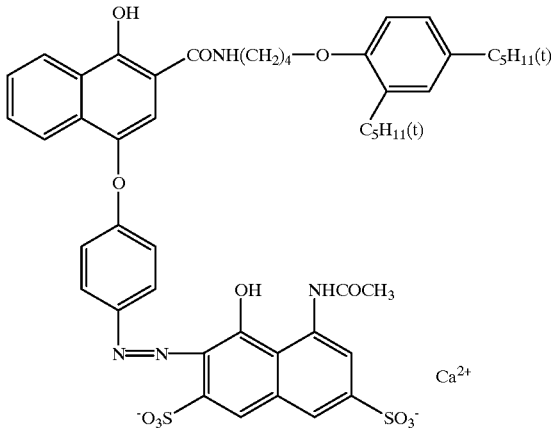
CM-1
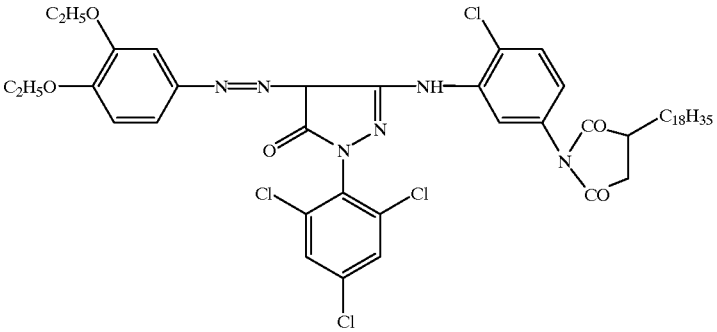
CM-2
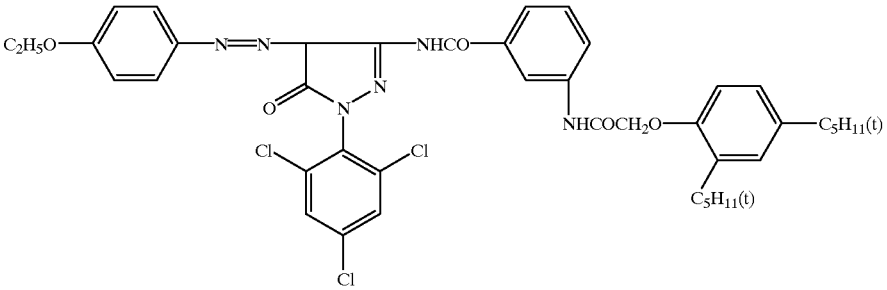
CM-3
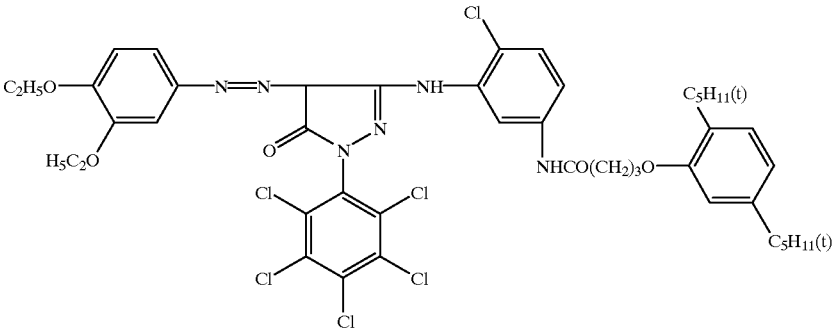

-continued
DI-1
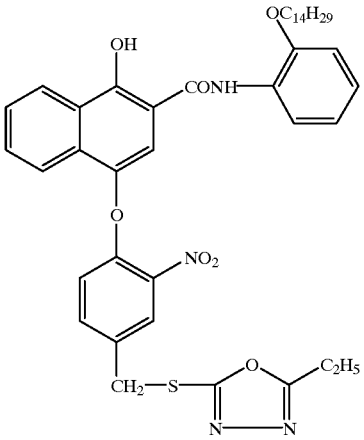
DI-2
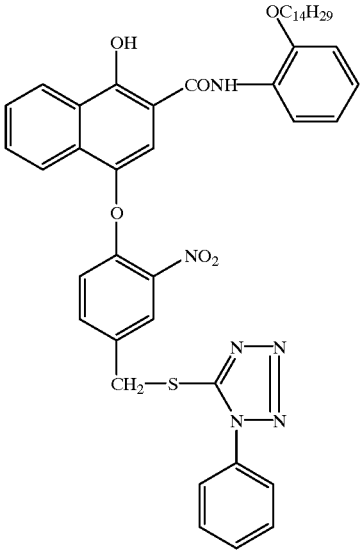
DI-3
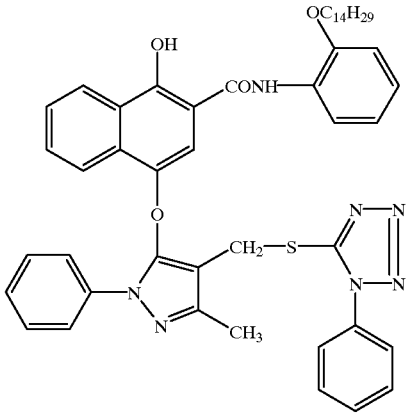

-continued
DI-4
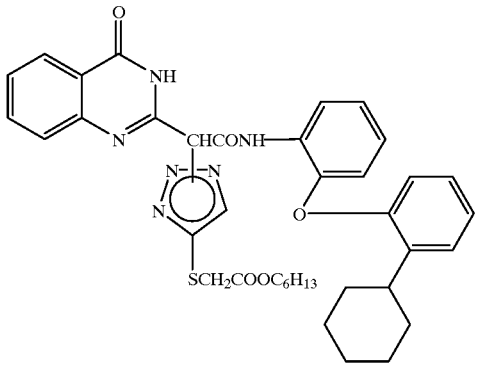
AS-1
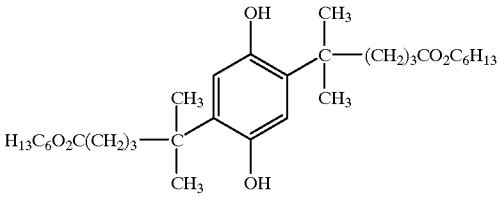
AS-2
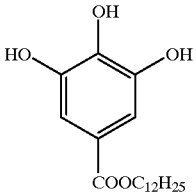
AS-3
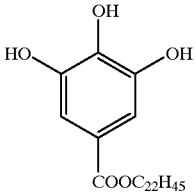
AS-4
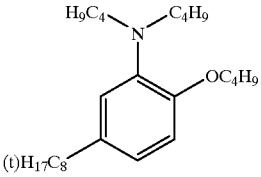
AS-5
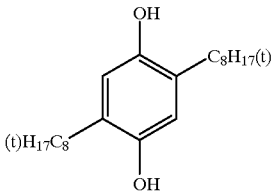
AS-6
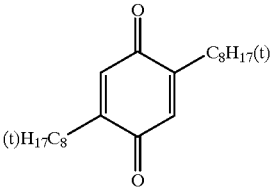

-continued
AS-7
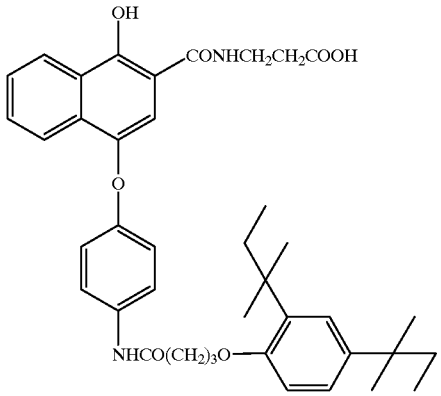
SD-1
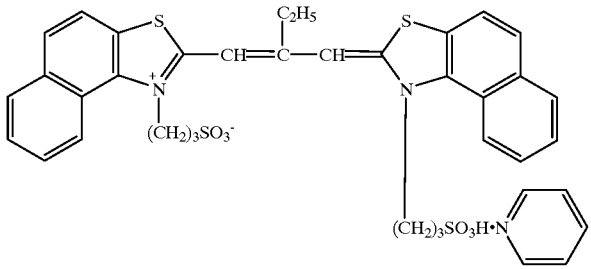
SD-2
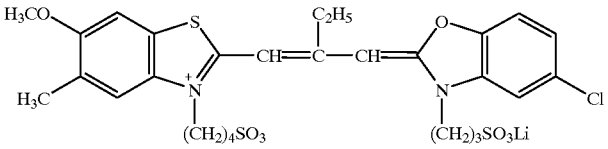
SD-3
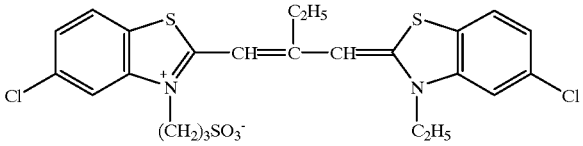
SD-4
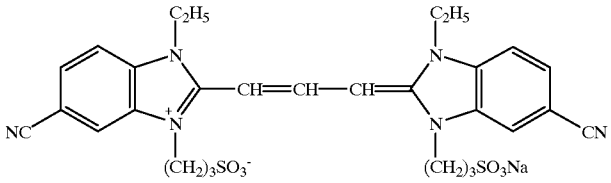
SD-5
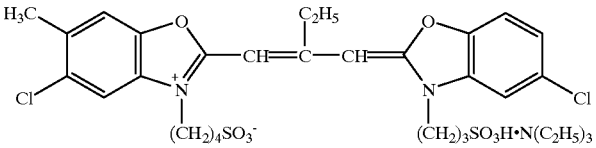
SD-6
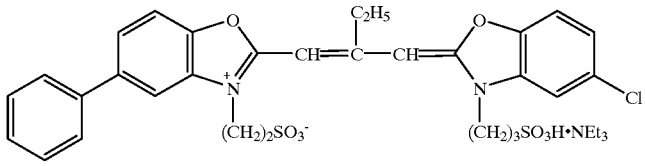

-continued
SD-7
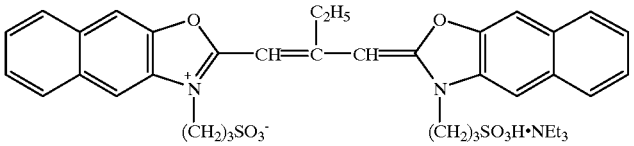
SD-8
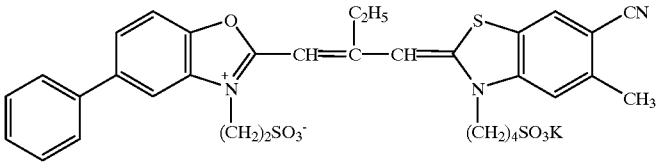
SD-9
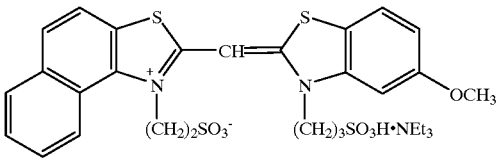
SD-10
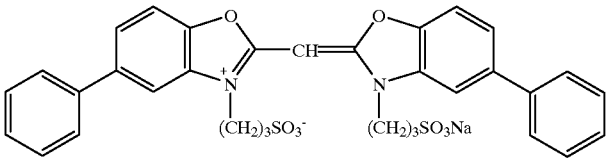
ST-1
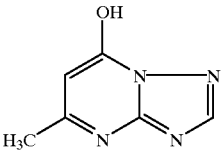
ST-2
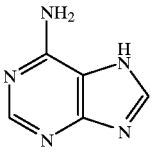
AF-1, 2
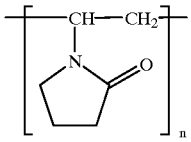
AF-1 Mw = 10,000
AF-2 Mw = 1,100,000
n: Degree of polymerization
AF-3
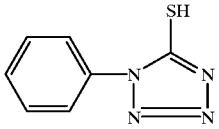
AF-4
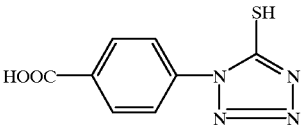

-continued
AF-5
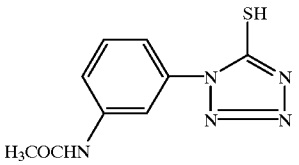
SU-1
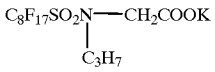
SU-2
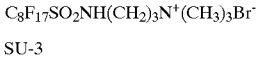
SU-3
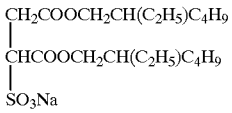
SU-4
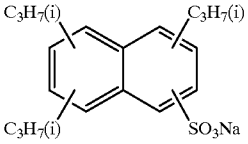
WAX-1
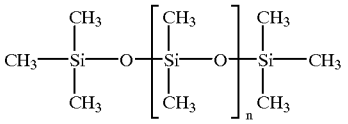
Mw = 3,000
D-1
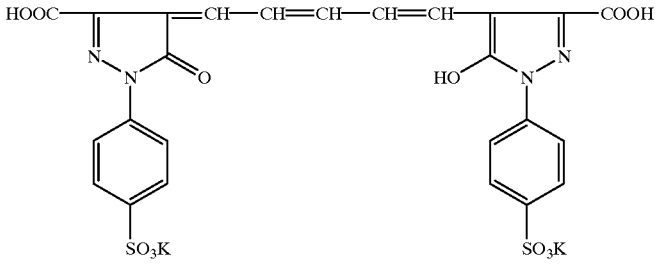
PM-1
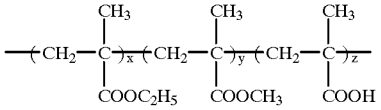
x:y:z = 3:3:4
PM-2
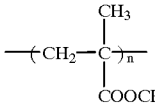
n: Degree of polymerization
OIL-1
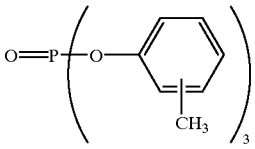

-continued
OIL-2
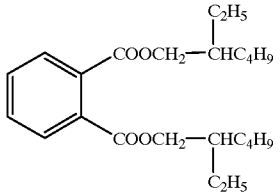
UV-1
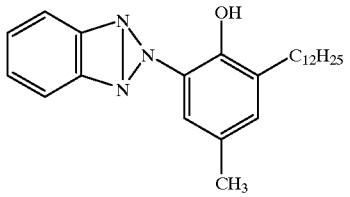
UV-2
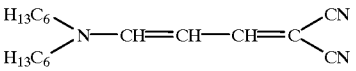
V-1
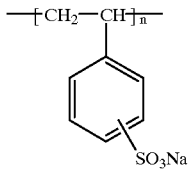
n: Degree of polymerization
Ase-1 (Mixture comprised of the following A, B and C))
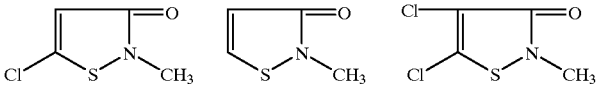
(A) (B) (C)
A:B:C = 5:40:4 (molar ratio)
H-1
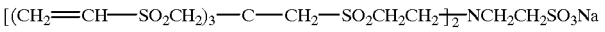
H-2
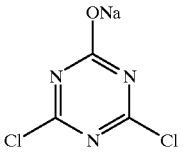

Samples 2 to 8 were prepared in the same manner as Sample 1, except that DIR compound (DI-4) used in the 12th layer and 13th layer was replaced by an equimolar amount of comparative DIR-1 or 2, inventive Compound 101, 102, 105, 106 or 110. Compound 101 is a mixture of the following position isomers.
101-a
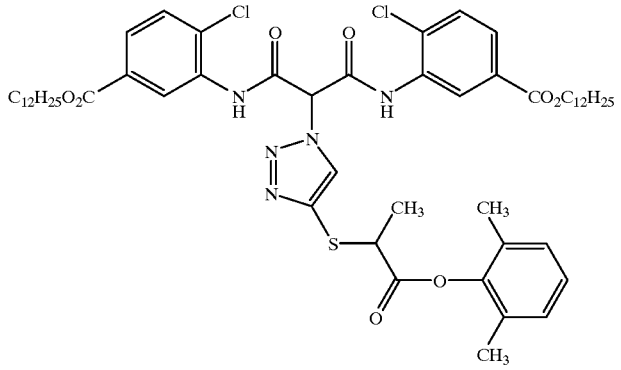
101-b
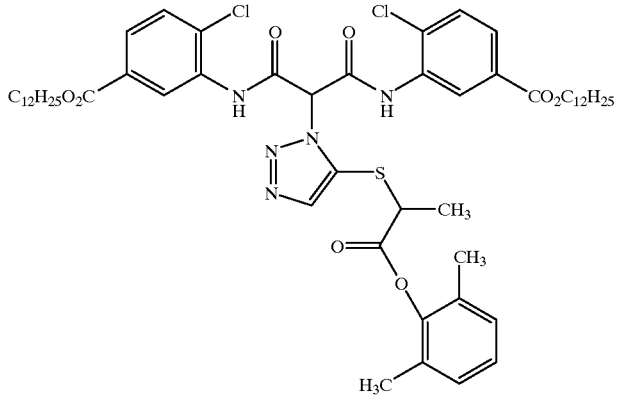
101-c
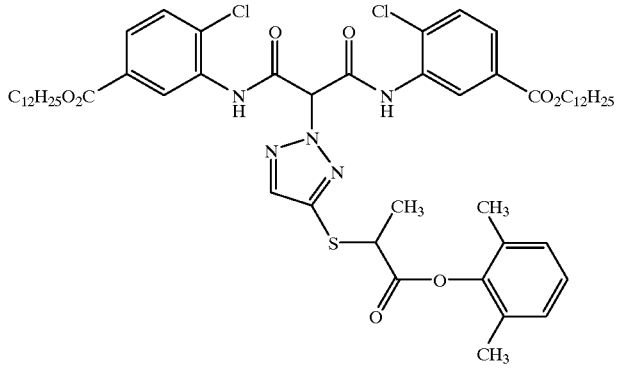

Similarly, Compounds 102, 105, 106 and 110 are each comprised of three position isomers.

Comparative DIR-1

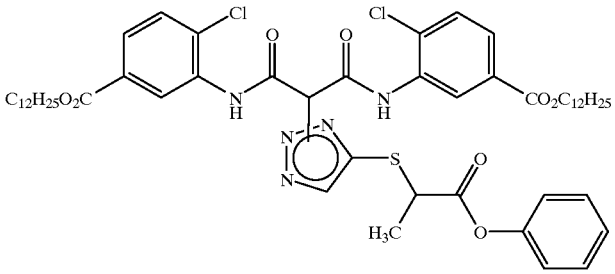

Comparative DIR-2

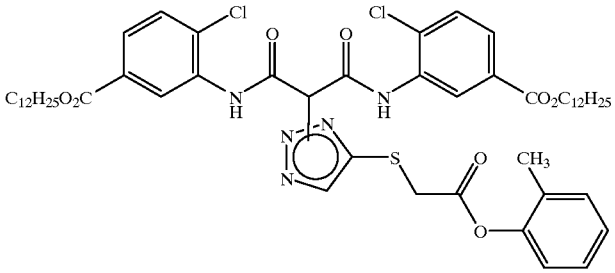

Comparative DIR-3

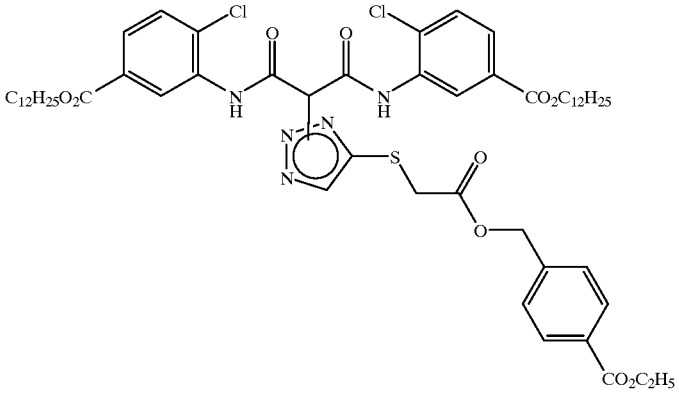

Comparative DIR-4

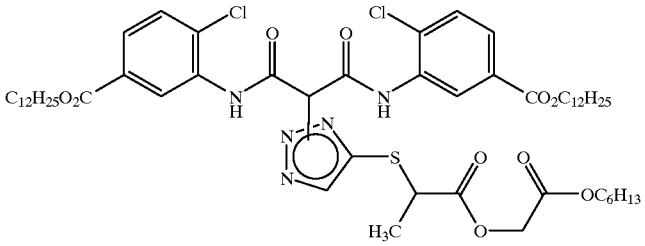

Samples 1 to 8 were allowed to stand at 55° C. and 20% RH over a period of 7 days. Non-aged fresh samples and samples aged as above (hereinafter, denoted as 55° C.-aging) were exposed to blue light through an optical wedge and processed according to the following process to determine the sensitivity and γ (contrast). The sensitivity was shown as a relative value, based on that of fresh Sample 1 being 100. The γ was also shown as a relative value, based on that of fresh sample 1 being 1.00. Image sharpness was also measured. Sharpness was shown as a relative value of MTF value at 30 lines/mm of dye images, based on that of Sample 1 being 100. Results are shown in Table 5.

Processing

| Step | Time | Temp. | Repl.* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |

-continued

| Step | Time | Temp. | Repl.* |
|---|---|---|---|
| Drying | 60 sec. | 55 ± 5.0° C. | — |

*Repl: Replenishing rate (ml/m$^2$)

Color developing solution

| | |
|---|---|
| Water | 800 ml |
| Potassium carbonate | 30 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxy-ethyl) aniline sulfate | 4.5 g |
| Diethylenetetraaminepentaacetic acid | 3.0 g |
| Potassium hydroxide | 1.2 g |

Water was added to make 1 liter and the pH was adjusted to 10.06 with potassium hydroxide or 20% sulfuric acid.

Color developer replenishing solution

| | |
|---|---|
| Water | 800 ml |
| Potassium carbonate | 35 g |
| Sodium hydrogencarbonate | 3.0 g |
| Potassium sulfite | 5.0 g |
| Sodium broinide | 0.4 g |
| Hydroxylamine sulfate | 3.1 g |
| 4-Amino-3-methyl-N-ethyl-N-(β-hydroxy-ethyl) aniline sulfate | 6.3 g |
| Diethylenetetraaminepentaacetic acid | 3.0 g |
| Potassium hydroxide | 2.0 g |

Water was added to make 1 liter and the pH was adjusted to 10.18 with potassium hydroxide or 20% sulfuric acid.

Bleaching solution

| | |
|---|---|
| Water | 700 ml |
| Ammonium iron (III) 1,3-diaminopropane-tetraacetate | 125 g |
| Ethylenediaminetetraacetic acid | 2 g |
| Sodium nitrate | 40 g |
| Ammonium bromide | 150 g |
| Glacial acetic acid | 40 g |

Water was added to make 1 liter and the pH was adjusted to 4.4 with ammonia water or glacial acetic acid.

Bleach replenishing solution

| | |
|---|---|
| Water | 700 ml |
| Ammonium iron (III) 1,3-diaminopropane-tetraacetate | 175 g |
| Ethylenediaminetetraacetic acid | 2 g |
| Sodium nitrate | 50 g |
| Ammonium bromide | 200 g |
| Glacial acetic acid | 56 g |

Water was added to make 1 liter and the pH was adjusted to 4.4 with ammonia water or glacial acetic acid.

Fixing solution

| | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

Water was added to make 1 liter and the pH was adjusted to 6.2 with ammonia water or glacial acetic acid.

Fixer replenishing solution

| | |
|---|---|
| Water | 800 ml |
| Ammonium thiocyanate | 150 g |
| Ammonium thiosulfate | 180 g |
| Sodium sulfite | 20 g |
| Ethylenediaminetetraacetic acid | 2 g |

Water was added to make 1 liter and the pH was adjusted to 6.5 with ammonia water or glacial acetic acid.

Stabilizing solution and stabilizer replenishing solution

| | |
|---|---|
| Water | 900 ml |
| p-Octylphenol · ethyleneoxide 10 mol adduct | 2.0 g |
| Dimethylol urea | 0.5 g |
| Hexamethylenetetraamine | 0.2 g |
| 1,2-Benzoisothiazoline-3-one | 0.1 g |
| Siloxane (L-77, produced by UCC) | 0.1 g |
| Ammnonia water | 0.5 ml |

Water was added to make 1 liter, and the pH was adjusted to 8.5 with ammonia water or 50% sulfuric acid.

TABLE 5

| | DIR compound in | Non-aged | | 55° C-aged | | |
|---|---|---|---|---|---|---|
| Sample | 12th and 13th layer | Sensitivity | γ | Sensitivity | γ | Sharpness |
| 1 | DI-4 | 100 | 1.0 | 89 | 0.82 | 100 |
| 2 | Comp. DIR-1 | 120 | 1.18 | 104 | 0.98 | 86 |
| 3 | Comp. DIR-2 | 118 | 1.20 | 98 | 0.94 | 83 |
| 4 | Compound 101 | 104 | 0.96 | 101 | 0.94 | 115 |
| 5 | Compound 102 | 100 | 0.94 | 98 | 0.90 | 108 |
| 6 | Compound 105 | 96 | 0.92 | 94 | 0.90 | 111 |
| 7 | Compound 106 | 98 | 0.90 | 94 | 0.88 | 112 |
| 8 | Compound 110 | 102 | 1.02 | 98 | 1.00 | 109 |

As can be seen from Table 5, comparative Sample 1 was marked in lowering of sensitivity and γ during storage. Comparative Samples 2 and 3 were marked in lowering of sensitivity and γ and little in improvements of sharpness. Contrarily, Samples 4 to 8 were marked in improvements of sharpness and little in lowering of sensitivity and γ during storage.

Example 2

Samples 9 to 14 were prepared in the same manner as Sample 1, except that DIR compound (DI-4) used in the 12th layer and 13th layer was replaced by an equimolar amount of comparative DIR-3, Compound 201, 202, 207, 212, or 213. Inventive Compound 201 is comprised of the following three position isomers:

201-a

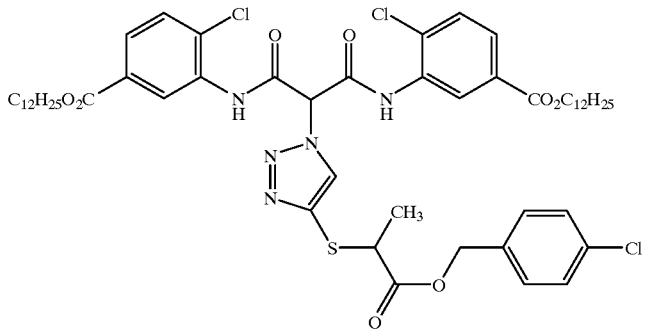

202-b

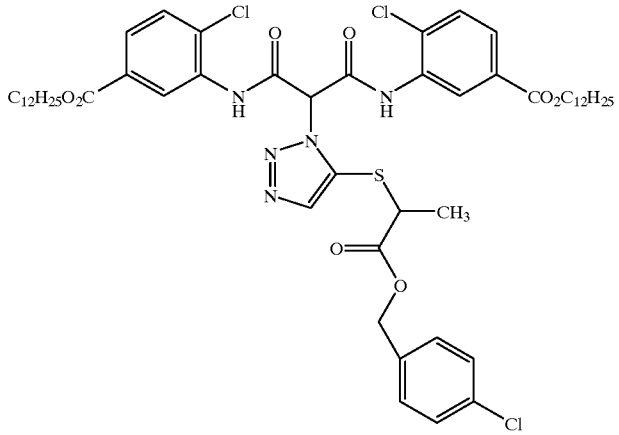

201-c

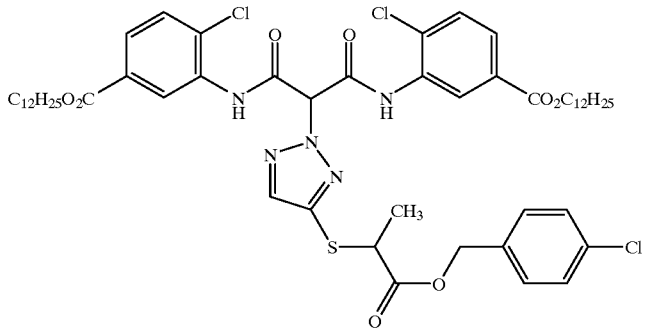

Similarly, Compounds 202, 207, 212 and 213 are each also comprised of three position isomers.

Samples were processed and evaluated in the same manner as in Example 1. Results are shown in Table 6. In the Table, the data of Samples 1 and 2 is repeated.

TABLE 6

| | DIR compound in | Non-aged | | 55° C-aged | | |
|---|---|---|---|---|---|---|
| Sample | 12th and 13th layer | Sensitivity | γ | Sensitivity | γ | Sharpness |
| 1 | DI-4 | 100 | 1.0 | 86 | 0.81 | 100 |
| 2 | Comp. DIR-1 | 120 | 1.18 | 104 | 0.98 | 86 |
| 9 | Comp. DIR-3 | 110 | 1.08 | 92 | 0.83 | 92 |
| 10 | Compound 201 | 103 | 1.02 | 101 | 1.00 | 116 |
| 11 | Compound 202 | 98 | 0.96 | 96 | 0.95 | 115 |

TABLE 6-continued

| | DIR compound in | Non-aged | | 55° C-aged | | |
|---|---|---|---|---|---|---|
| Sample | 12th and 13th layer | Sensitivity | γ | Sensitivity | γ | Sharpness |
| 12 | Compound 207 | 96 | 0.94 | 93 | 0.90 | 114 |
| 13 | Compound 121 | 106 | 1.10 | 104 | 1.08 | 105 |
| 14 | Compound 213 | 103 | 1.03 | 102 | 1.00 | 120 |

As can be seen from Table 6, comparative Sample 1 was marked in lowering of sensitivity and γ during storage. Comparative Samples 2 and 9 were marked in lowering of sensitivity and γ and little in improvements of sharpness. Contrarily, Samples 10 to 14 were marked in improvements of sharpness and little in lowering of sensitivity and γ during storage.

Example 3
Samples 15 to 20 were prepared in the same manner as Sample 1, except that DIR compound (DI-4) used in the 12th layer and 13th layer was replaced by an equimolar amount of comparative DIR-4 or DIR-5, Compound 301, 303, 304, or 305. Compound 301 is comprised of the following three position isomers:
301-a
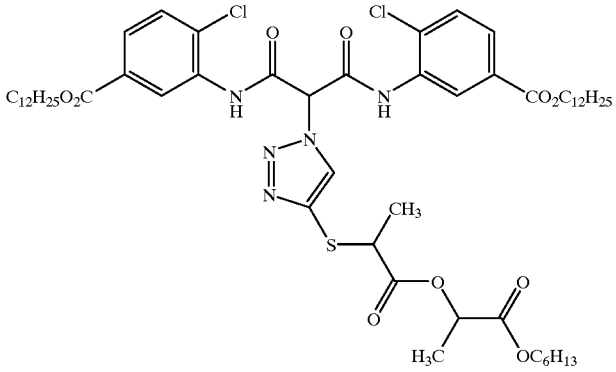
301-b
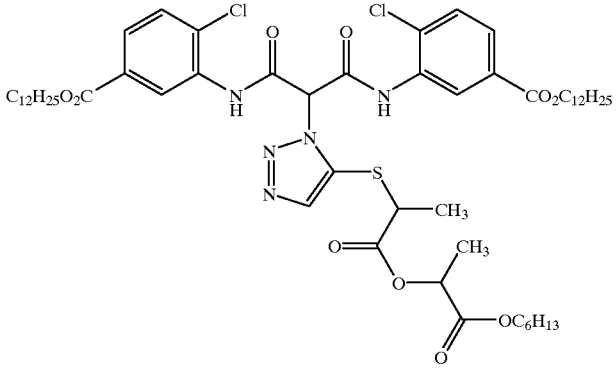
301-c
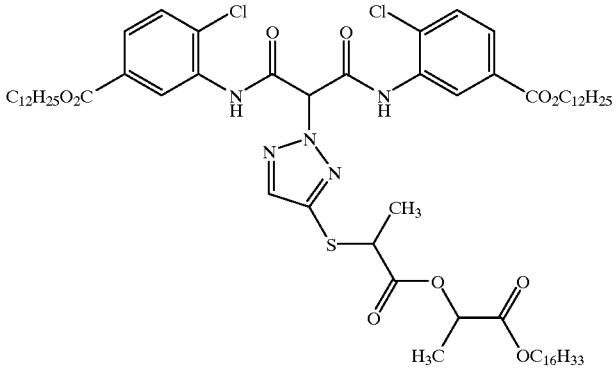

Compounds 303, 304 and 305 are each also comprised of three position isomers.

Comparative DIR-5

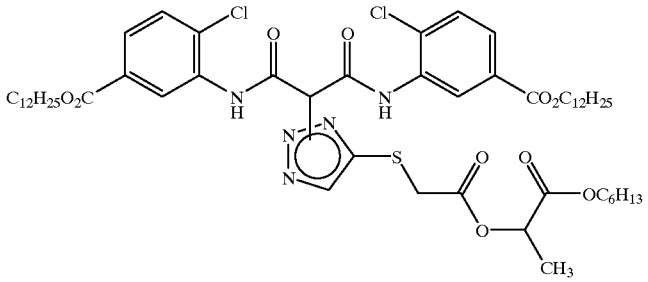

Comparative DIR-6

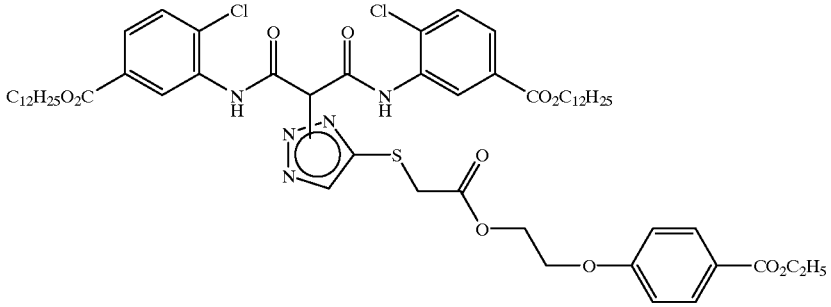

Comparative DIR-7

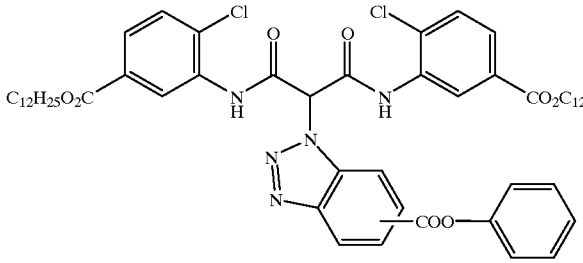

Comparative DIR-8

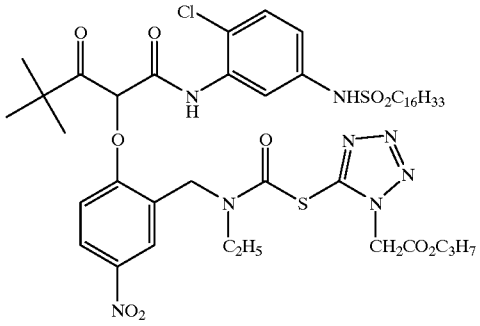

Samples were processed and evaluated in the same manner as in Example 1. Results are shown in Table 7. In the Table, the data of Samples 1 is repeated.

TABLE 7

| | DIR compound in | Non-aged | | 55° C-aged | | |
|---|---|---|---|---|---|---|
| Sample | 12th and 13th layer | Sensitivity | γ | Sensitivity | γ | Sharpness |
| 1 | DI-4 | 100 | 1.00 | 89 | 0.82 | 100 |
| 15 | Comp. DIR-4 | 118 | 1.16 | 100 | 1.04 | 84 |

TABLE 7-continued

| | DIR compound in | Non-aged | | 55° C-aged | | |
|---|---|---|---|---|---|---|
| Sample | 12th and 13th layer | Sensitivity | γ | Sensitivity | γ | Sharpness |
| 16 | Comp. DIR-5 | 109 | 1.10 | 88 | 1.00 | 86 |
| 17 | Compound 301 | 98 | 0.90 | 95 | 0.90 | 110 |
| 18 | Compound 302 | 102 | 1.14 | 99 | 1.08 | 114 |
| 19 | Compound 304 | 96 | 0.88 | 95 | 0.86 | 110 |
| 20 | Compound 305 | 96 | 0.86 | 94 | 0.83 | 112 |

As can be seen from Table 7, comparative Sample 1 was marked in lowering of sensitivity and γ during storage. Comparative Samples 15 and 16 were marked in lowering of sensitivity and γ and little in improvements of sharpness. Contrarily, Samples 17 to 20 were marked in improvements of sharpness and little in lowering of sensitivity and γ during storage.

Example 4

Samples 21 to 25 were prepared in the same manner as Sample 1, except that DIR compound (DI-4) used in the 12th layer and 13th layer was replaced by an equimolar amount of comparative DIR-6, Compound 401, 402, 406, or 407. Compound 401 is comprised of the following three position isomers:

401-a

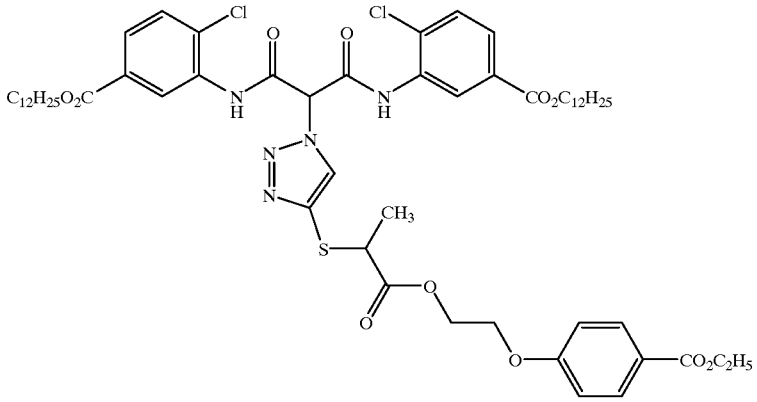

401-b

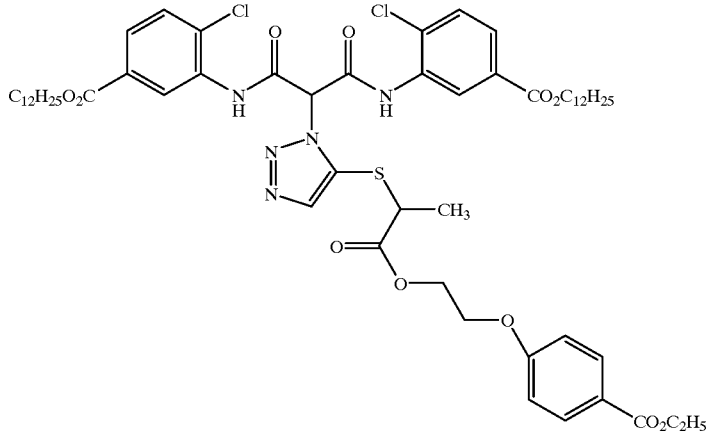

401-c

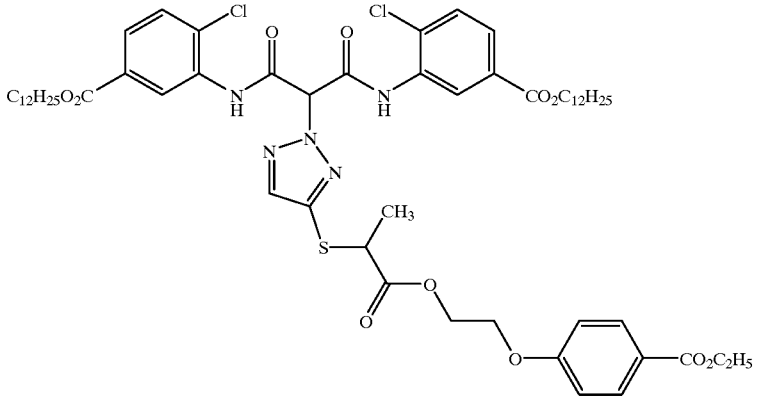

Similarly, Compounds 402, 406 and 407 are each also comprised of three position isomers.

Samples were processed and evaluated in the same manner as in Example 1. Results are shown in Table 7. In the Table, the data of Samples 1 is repeated.

TABLE 8

| Sample | DIR compound in 12th and 13th layer | Non-aged Sensitivity | Non-aged γ | 55° C-aged Sensitivity | 55° C-aged γ | Sharpness |
|---|---|---|---|---|---|---|
| 1 | DI-4 | 100 | 1.0 | 89 | 0.82 | 100 |
| 21 | Comp. DIR-6 | 108 | 1.14 | 98 | 0.98 | 89 |
| 22 | Compound 401 | 98 | 0.89 | 96 | 0.86 | 113 |
| 23 | Compound 402 | 94 | 0.83 | 91 | 0.83 | 110 |
| 24 | Compound 406 | 102 | 1.05 | 100 | 1.02 | 115 |
| 25 | Compound 407 | 102 | 1.00 | 99 | 1.01 | 112 |

As can be seen from Table 8, comparative Sample 1 was marked in lowering of sensitivity and γ during storage. Comparative Sample 21 were marked in lowering of sensitivity and γ and little in improvements of sharpness. Contrarily, Samples 22 to 25 were marked in improvements of sharpness and little in lowering of sensitivity and γ during storage.

Example 5

On a triacetate base was coated the following layers in this order to prepare a control sample:

(1) red sensitive silver iodobromide emulsion layer containing 0.5 g of a cyan coupler (C-2), 2.4 g/m$^2$ of gelatin and 1.6 g/m$^2$ of silver halide, (2) interlayer containing 0.5 g/m$^2$ of gelatin and 0.1 g/m$^2$ of 2,5-di-t-octylhydroquinone, (3) blue sensitive silver iodobromide emulsion layer containing 1.7 g/m$^2$ of a yellow coupler (Ya-1), 2.4 g/m$^2$ of gelatin and 1.6 g/m$^2$ of silver halide, and (4) protective layer containing 0.8 g/m$^2$ of gelatin.

Samples 26 to 32 were prepared in the same manner as Control sample, except that to the layer (3) containing a yellow coupler was added $3.0\times10^{-4}$ mol/m$^2$ of a DIR compound as shown in Table 9.

Samples each were exposed to white light, and separately, samples were each exposed to red light. Thus-exposed samples were processed in the same manner as in Example 1. From a cyan dye image characteristic curve of each sample was determined a γ value, and values of $\gamma_R/\gamma_W$ are shown in Table 9, wherein $\gamma_R$ and $\gamma_W$ represent a γ value at red light exposure or white light exposure, respectively.

TABLE 9

| Sample | DIR compound | $\gamma_R/\gamma_W$ |
|---|---|---|
| 26 | DI-4 | 1.16 |
| 27 | Comp. DIR-7 | 1.20 |
| 28 | Comp. DIR-8 | 1.22 |
| 29 | Compound 101 | 1.43 |
| 30 | Compound 102 | 1.40 |
| 31 | Compound 107 | 1.41 |
| 32 | Compound 114 | 1.39 |

As can be seen from Table 9, when the compound according to the invention was used, $\gamma_R/\gamma_W$ became larger, indicating enhanced interlayer effect, as compared to the use of DIR couplers known in the art. Thus, the DIR coupler according to the invention was proved to be effective in an improvement of color reproduction.

Example 6

Samples 33 to 36 were prepared in the same manner as Control sample of Example 5, except that to the layer (3) containing a yellow coupler was added $3.0\times10^{-4}$ mol/m$^2$ of a DIR compound as shown in Table 10. Samples each were exposed to white light, and separately, samples were each exposed to red light. Thus-exposed samples were processed in the same manner as in Example 1. From a cyan dye image characteristic curve of each sample was determined a γ value, and values of $\gamma_R/\gamma_W$ are shown in Table 9, wherein $\gamma_R$ and $\gamma_W$ represent a γ value at red light exposure or white light exposure, respectively.

TABLE 10

| Sample | DIR compound | $\gamma_R/\gamma_W$ |
|---|---|---|
| 26 | DI-4 | 1.16 |
| 27 | Comp. DIR-7 | 1.20 |
| 28 | Comp. DIR-8 | 1.22 |
| 33 | Compound 201 | 1.44 |
| 34 | Compound 202 | 1.40 |
| 35 | Compound 207 | 1.38 |
| 36 | Compound 213 | 1.46 |

As can be seen from Table 10, when the compound according to the invention was used, $\gamma_R/\gamma_W$ became larger, indicating enhanced interlayer effect, as compared to the use of DIR couplers known in the art. Thus, the DIR coupler according to the invention was proved to be effective in an improvement of color reproduction.

Example 7

Samples 37 to 40 were prepared in the same manner as Control sample of Example 5, except that to the layer (3) containing a yellow coupler was added $3.0\times10^{-4}$ mol/m$^2$ of a DIR compound as shown in Table 11. Samples each were exposed to white light, and separately, samples were each exposed to red light. Thus-exposed samples were processed in the same manner as in Example 1. From a cyan dye image characteristic curve of each sample was determined a γ value, and values of $\gamma_R/\gamma_W$ are shown in Table 9, wherein $\gamma_R$ and $\gamma_W$ represent a γ value at red light exposure or white light exposure, respectively.

TABLE 11

| Sample | DIR compound | $\gamma_R/\gamma_W$ |
|---|---|---|
| 26 | DI-4 | 1.16 |
| 27 | Comp. DIR-7 | 1.20 |
| 28 | Comp. DIR-8 | 1.22 |
| 37 | Compound 301 | 1.38 |
| 38 | Compound 303 | 1.41 |
| 39 | Compound 304 | 1.40 |
| 40 | Compound 305 | 1.37 |

As can be seen from Table 11, when the compound according to the invention was used, $\gamma_R/\gamma_W$ became larger, indicating enhanced interlayer effect, as compared to the use of DIR couplers known in the art. Thus, the DIR coupler according to the invention was proved to be effective in an improvement of color reproduction.

Example 8

Samples 41 to 44 were prepared in the same manner as Control sample of Example 5, except that to the layer (3) containing a yellow coupler was added $3.0\times10^{-4}$ mol/m$^2$ of a DIR compound as shown in Table 11. Samples each were exposed to white light, and separately, samples were each exposed to red light. Thus-exposed samples were processed in the same manner as in Example 1. From a cyan dye image characteristic curve of each sample was determined a γ value, and values of $\gamma_R/\gamma_W$ are shown in Table 9, wherein $\gamma_R$ and $\gamma_W$ represent a γ value at red light exposure or white light exposure, respectively.

TABLE 12

| Sample | DIR compound | $\gamma_R/\gamma_W$ |
|---|---|---|
| 26 | DI-4 | 1.16 |
| 27 | Comp. DIR-7 | 1.20 |
| 28 | Comp. DIR-8 | 1.22 |
| 41 | Compound 401 | 1.39 |
| 42 | Compound 404 | 1.41 |
| 43 | Compound 406 | 1.38 |
| 44 | Compound 407 | 1.36 |

As can be seen from Table 12, when the compound according to the invention was used, $\gamma_R/\gamma_W$ became larger, indicating enhanced interlayer effect, as compared to the use of DIR couplers known in the art. Thus, the DIR coupler according to the invention was proved to be effective in an improvement of color reproduction.

What is claimed is:

1. A silver halide light sensitive color photographic material comprising a support having thereon hydrophilic colloid layers including a silver halide emulsion layer, at least one of the hydrophilic colloid layers containing a compound represented by the following formula (101), (201), (301) or (401):

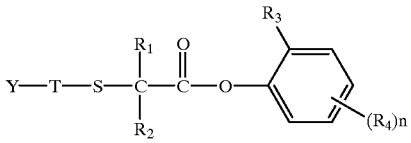

wherein Y represents a yellow coupler moiety capable of coupling reaction with an oxidation product of a color developing agent; T represents a 1,2,4-triazole skeleton or 1.2,3-triazole skeleton, provided that T is linked to a coupling position of Y through a nitrogen atom contained in T; S represents a sulfur atom which is linked to a carbon atom contained in T; $R_1$ represents a hydrogen atom, an alkyl group or an aryl group; $R_2$ represents an alkyl group or an aryl group; $R_3$ represents an alkyl group or an aryl group; $R_4$ represents a substituent; and n is an integer of 0, 1, 2, 3 or 4;

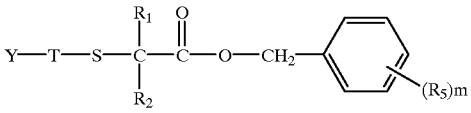

wherein Y represents a yellow coupler moiety capable of coupling reaction with an oxidation product of a color developing agent; T represents a 1,2,4-triazole skeleton or 1.2,3-triazole skeleton, provided that T is linked to a coupling position of Y through a nitrogen atom contained in T; S represents a sulfur atom which is linked to a carbon atom contained in T; $R_1$ represents a hydrogen atom, an alkyl group or an aryl group; $R_2$ represents an alkyl group or an aryl group; $R_5$ represents a substituent; and m is an integer of 0, 1, 2, 3, 4 or 5;

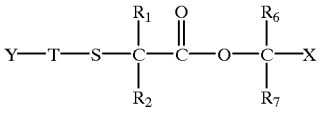

wherein Y represents a yellow coupler moiety capable of coupling reaction with an oxidation product of a color developing agent; T represents a 1,2,4-triazole skeleton or 1.2,3-triazole skeleton, provided that T is linked to a coupling position of Y through a nitrogen atom contained in T; S represents a sulfur atom which is linked to a carbon atom contained in T; $R_1$ represents a hydrogen atom, an alkyl group or an aryl group, each of which may be substituted; $R_2$ represented an alkyl group or an aryl group, each of which may be substituted; $R_6$ represents a hydrogen atom, an alkyl group or an aryl group; $R_7$ represents an alkyl group or an aryl group; and X represents an oxycarbonyl, carbamoyl or carbonyl group;

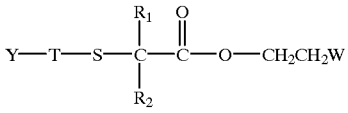

wherein Y represents a yellow coupler moiety capable of coupling reaction with an oxidation product of a color developing agent; T represents a 1,2,4-triazole skeleton or 1.2,3-triazole skeleton, provided that T is linked to a coupling position of Y through a nitrogen atom contained in T; S represents a sulfur atom which is linked to a carbon atom contained in T; $R_1$ represents a hydrogen atom, an alkyl group or an aryl group; $R_2$ represented an alkyl group or an aryl group; W represents an aryloxy, arylthio or sulfonyl group.

2. The silver halide photographic material of claim 1, wherein the yellow coupler moieties represented by Y in formulas (101) through (401) is one of the following Y-1 through Y-10, in which the symbol "*" represents a position linking with T,

Y-1

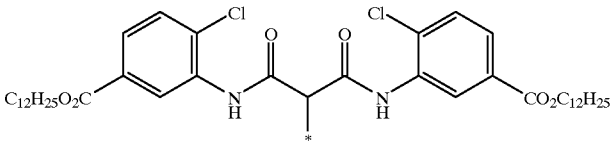

-continued
Y-2
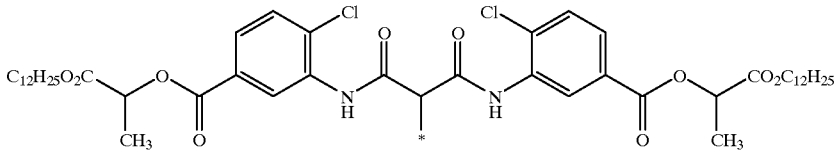
Y-3
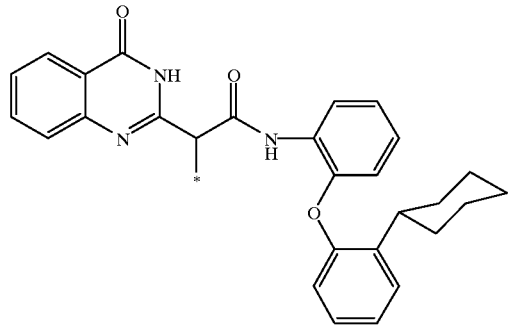
Y-4
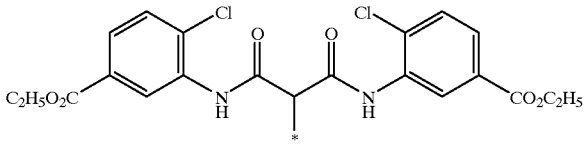
Y-5
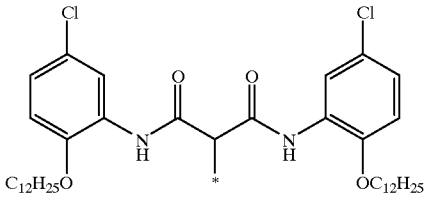
Y-6
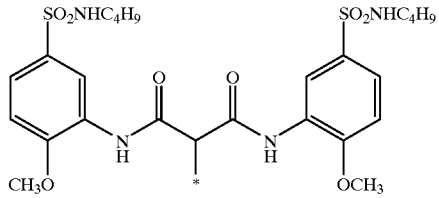
Y-7
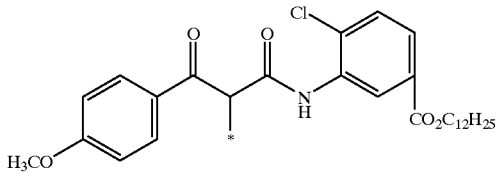
Y-8
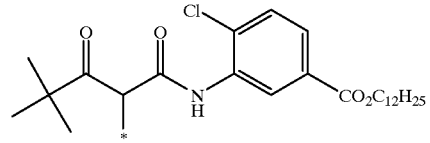

-continued

Y-9

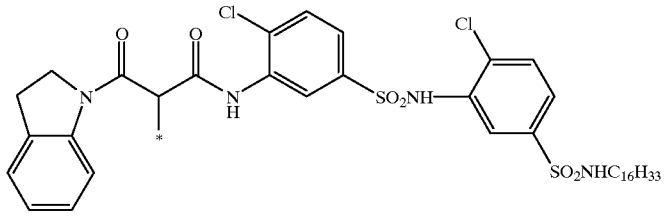

Y-10

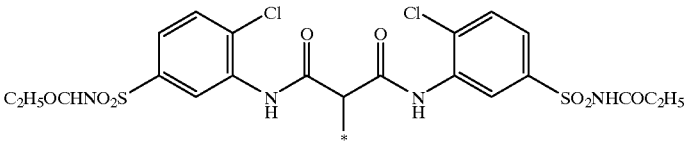

3. The silver halide photographic material of claim 1, wherein the T in formulas (101) through (401) is one represented by the following formulas (102), (103), (104) or (105):

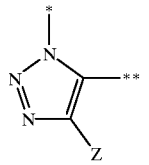

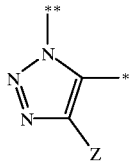

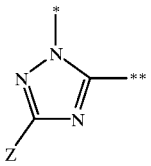

-continued

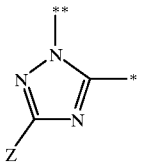

wherein the symbol "*" represents a position linking with the yellow coupler moiety, Y; the symbol "**" represents a position linking with a S atom; and Z represents a hydrogen atom or substituent.

4. The silver halide photographic material of claim 1, wherein in formulas (101) through (401), $R_1$ is a hydrogen atom and $R_2$ is an alkyl group having 4 or less carbon atoms.

* * * * *

UNITED STATES PATENT AND TRADEMARK OFFICE

CERTIFICATE OF CORRECTION

PATENT NO. : 6,027,867

DATED : February 22, 2000

INVENTOR(S) : Ishige, et al

It is certified that error appears in the above-identified patent and that said Letters Patent is hereby corrected as shown below:

Title page item [30], Foreign Application Priority Data, cancel "8-168844" insert -- 9-168844 --

Signed and Sealed this

Ninth Day of January, 2001

*Attest:*

*Attesting Officer*

Q. TODD DICKINSON

*Commissioner of Patents and Trademarks*